US011543198B2

(12) United States Patent
Lee et al.

(10) Patent No.: US 11,543,198 B2
(45) Date of Patent: Jan. 3, 2023

(54) MONOLITHIC UPPER RECEIVER FOR FIREARMS WITH BARREL LOCKING SYSTEM AND FOLDABLE AMBIDEXTROUS FORWARD ASSIST

(71) Applicant: Strike IP, LLC, Las Vegas, NV (US)

(72) Inventors: Shanyao Lee, Santa Ana, CA (US); Chien Yuan Cheng, Santa Ana, CA (US)

(73) Assignee: Strike IP, LLC, Las Vegas, NV (US)

( * ) Notice: Subject to any disclaimer, the term of this patent is extended or adjusted under 35 U.S.C. 154(b) by 0 days.

(21) Appl. No.: 17/534,582

(22) Filed: Nov. 24, 2021

(65) Prior Publication Data

US 2022/0178632 A1 Jun. 9, 2022

Related U.S. Application Data

(60) Provisional application No. 63/122,443, filed on Dec. 7, 2020.

(51) Int. Cl.

| | |
|---|---|
| ***F41A 21/48*** | (2006.01) |
| ***F41A 3/72*** | (2006.01) |
| ***F41A 35/06*** | (2006.01) |
| ***F41A 3/66*** | (2006.01) |

(52) U.S. Cl.

CPC ..... *F41A 3/72* (2013.01); *F41A 3/66* (2013.01); *F41A 21/485* (2013.01); *F41A 35/06* (2013.01)

(58) Field of Classification Search

CPC ..... F41A 21/48; F41A 21/485; F41A 21/487; F41A 21/481

USPC ..... 42/75.02, 75.01

See application file for complete search history.

(56) References Cited

U.S. PATENT DOCUMENTS 9,702,652 B1 * 7/2017 Jackson ..... F41A 21/482

FOREIGN PATENT DOCUMENTS

DE 10213292 A1 * 10/2003 ..... F41A 21/00

* cited by examiner

*Primary Examiner* — Reginald S Tillman, Jr.

(74) *Attorney, Agent, or Firm* — Han IP PLLC; Andy M. Han

(57) ABSTRACT

A device implementable on a firearm includes a monolithic upper receiver, comprising an upper receiver portion and a handguard portion, which is configured to accommodate non-proprietary barrel assemblies dimensioned according to United States military standard (mil-spec) barrel assembly dimensions and non-proprietary bolt carrier groups (BCGs) dimensioned according to mil-spec BCG dimensions. The device also includes a charging handle assembly configured to be coupled to an operating rod of a gas system of the firearm and forward of a BCG of the firearm. The device further includes a barrel locking system including a locking plate and a locking screw. When the locking screw is screwed into a threaded hole on the locking plate, the locking plate engages with a side of a barrel extension of the barrel assembly in a radial directions perpendicular to a longitudinal axis of the barrel assembly.

14 Claims, 25 Drawing Sheets

200

300

300

MONOLITHIC UPPER RECEIVER FOR FIREARMS WITH BARREL LOCKING SYSTEM AND FOLDABLE AMBIDEXTROUS FORWARD ASSIST

CROSS REFERENCE TO RELATED PATENT APPLICATION(S)

The present disclosure is part of a non-provisional patent application claiming the priority benefit of U.S. Provisional Patent Application No. 63/122,443, filed 7 Dec. 2020, the content of which being incorporated by reference in its entirety.

TECHNICAL FIELD

The present disclosure is generally related to firearms and, more particularly, to a monolithic upper receiver for firearms with an ambidextrous forward assist and an improved barrel locking system.

BACKGROUND

Unless otherwise indicated herein, approaches described in this section are not prior art to the claims listed below and are not admitted as prior art by inclusion in this section.

On firearms based on an AR platform, such as AR15-styled or AR10-styled rifles, carbines, pistols and shotguns, the major portions typically include a lower receiver, an upper receiver, and a barrel. The lower receiver is where a trigger mechanism is installed as well as where a pistol grip and a stock or buffer tube are attached. The upper receiver is where a bolt carrier group (BCG) is received and operates. The upper receiver is also connected to the barrel, along with a gas tube (for those firearms using a direct impingement system for cycling the BCG) or a piston system (for those firearms using a gas piston system for cycling the BCG). Additionally, a handguard which surrounds the barrel is also attached to the barrel. On modern firearms, there are typically an accessory rail (e.g., Picatinny rail, also known as a MIL-STD-1913 rail, or a Weaver rail) on the top side of each of the upper receiver and handguard (hereinafter referred to as a "top rail") to allow a user to mount accessories such as optics and/or iron sights. However, due to differences in tolerance and/or fit and finish, there could be a gap between the top rail of the upper receiver and the top rail of the handguard which may interfere with optics mounting.

Additionally, a conventional upper receiver typically has a forward assist built in on the right side thereof behind the casing ejection port. Correspondingly, the bolt carrier needs to have serrations machined on its side to allow engagement by the forward assist. However, this tends to increase the cost of manufacturing and this design tends to allow debris to enter the upper receiver. Besides, by being on one side of the upper receiver, the forward assist tends to make the upper receiver look bulky. Moreover, as the forward assist is on the right-hand side of the firearm from the perspective of a user, it would be inconvenient for a right-handed shooter if he/she intends to use his/her support hand (i.e., left hand) to operate the forward assist. Furthermore, on a conventional firearm based on an AR platform, a barrel nut is typically used to secure the handguard onto the upper receiver. However, in an event that a user intends to change or replace the barrel, it would require the removal of the handguard and gas tube (or piston system) before the user can access and loosen the barrel nut.

SUMMARY

The following summary is illustrative only and is not intended to be limiting in any way. That is, the following summary is provided to introduce concepts, highlights, benefits and advantages of the novel and non-obvious techniques described herein. Select implementations are further described below in the detailed description. Thus, the following summary is not intended to identify essential features of the claimed subject matter, nor is it intended for use in determining the scope of the claimed subject matter.

In view of the aforementioned issues, an objective of the present disclosure is to propose an innovative design of a monolithic upper receiver for firearms with an ambidextrous forward assist and an improved barrel locking system. It is believed that, compared to conventional designs, a monolithic upper receiver with an ambidextrous forward assist and an improved barrel locking system under various proposed designs in accordance with the present disclosure would provide greater flexibility and convenience while maintaining accuracy and precision for a user in operating and maintaining a firearm. For instance, the monolithic upper receiver may be designed, dimensioned or otherwise configured to accommodate original AR barrel and bolt/BCG (e.g., ones that are built per military standard, or "mil-spec"). Additionally, the forward assist according to the present disclosure may be located at a far end of the receiver (away from the user) and thus, while functioning as a conventional forward assist, there would be no need for the user to pivot the firearm to one side while trying to access the forward assist. Moreover, the barrel locking system according to the present disclosure would allow a user easy access from one side of the receiver without removal of the handguard or gas tube/piston system.

In one aspect, a device implementable on a firearm (e.g., a firearm based on an AR platform such as an AR15-styled or AR10-styled rifle, carbine, pistol or shotgun) may include a monolithic upper receiver including an upper receiver portion and a handguard portion that are integra parts of the monolithic upper receiver which is a one-piece component of the firearm. In some implementations, the monolithic upper receiver may be configured to accommodate non-proprietary barrel assemblies dimensioned according to mil-spec barrel assembly dimensions and non-proprietary BCGs dimensioned according to mil-spec BCG dimensions.

In one aspect, a device implementable on a firearm (e.g., a firearm based on an AR platform such as an AR15-styled or AR10-styled rifle, carbine, pistol or shotgun) may include a charging handle assembly configured to be coupled to an operating rod of a gas system of the firearm and forward of a BCG of the firearm. Accordingly, in operation: (a) the charging handle assembly may be configured to be pulled rearward with respect to the firearm to engage with a front end of the operating rod, and (b) when in a forward assist mode, the charging handle assembly may be configured to be pulled forward with respect to the firearm to pull the operating rod and the BCG forward.

In one aspect, a device implementable on a firearm (e.g., a firearm based on an AR platform such as an AR15-styled or AR10-styled rifle, carbine, pistol or shotgun) may include a barrel locking system including, for each of two opposite sides of a barrel assembly of the firearm, a locking plate and a locking screw. In some implementations, the locking plate may be configured with a threaded hole to accommodate the locking screw. Accordingly, when the locking screw is screwed into the threaded hole, the locking plate may be configured to engage with a side of a barrel extension of the barrel assembly in a radial directions perpendicular to a longitudinal axis of the barrel assembly.

BRIEF DESCRIPTION OF THE DRAWINGS

The accompanying drawings are included to provide a further understanding of the disclosure and are incorporated in and constitute a part of the present disclosure. The drawings illustrate implementations of the disclosure and, together with the description, explain the principles of the disclosure. It is appreciable that the drawings are not necessarily in scale as some components may be shown to be out of proportion than the size in actual implementation to clearly illustrate the concept of the present disclosure.

DETAILED DESCRIPTION OF PREFERRED IMPLEMENTATIONS

Figure 1:
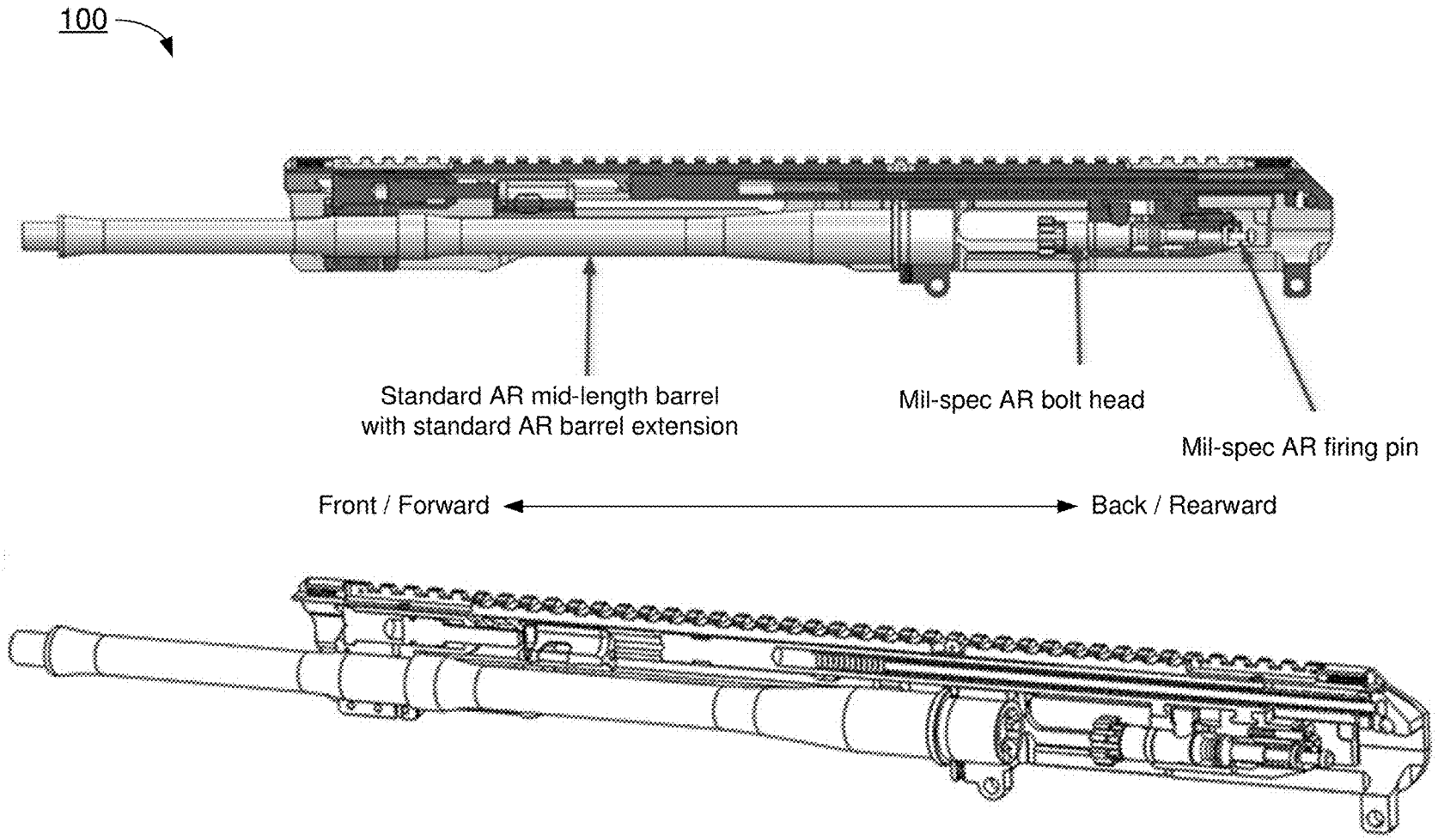
FIG. 1 is a diagram of a monolithic upper receiver in accordance with an implementation of the present disclosure.

Detailed embodiments and implementations of the claimed subject matters are disclosed herein. However, it shall be understood that the disclosed embodiments and implementations are merely illustrative of the claimed subject matters which may be embodied in various forms. The present disclosure may, however, be embodied in many different forms and should not be construed as limited to the exemplary embodiments and implementations set forth herein. Rather, these exemplary embodiments and implementations are provided so that description of the present disclosure is thorough and complete and will fully convey the scope of the present disclosure to those skilled in the art. In the description below, details of well-known features and techniques may be omitted to avoid unnecessarily obscuring the presented embodiments and implementations.

The position terms used in the present disclosure, such as "front", "forward", "rear", "back", "top", "bottom", "left", "right", "head", "tail" or the like assume a firearm in the normal firing position, with the firearm being in a position in which the longitudinal axis of the barrel of the firearm runs generally horizontally and the direction of firing points "forward" away from the operator or user of the firearm. The same convention applies for the direction statements used herein.

As used herein, the terms "proximal" and "proximally" may denote "forward" and "forwardly" with respect to the firearm, and the terms "distal" and "distally" may denote "rearward" and "rearwardly" with respect to the firearm. As used herein, the verb "to comprise" in this description, claims, and other conjugations are used in its non-limiting sense to mean those items following the word are included, but items not specifically mentioned are not excluded. As used herein, the word "forward" means moving in the direction that the projectile moves during firing a firearm. As used herein, the word "proximal" means closer to the reference point, in this case, the shooter. As used herein, the word "distal" means farther to the reference point, in this case, the shooter. Reference to an element by the indefinite article "a" or "an" does not exclude the possibility that more than one of the elements are present, unless the context clearly requires that there is one and only one of the elements. The indefinite article "a" or "an" thus usually means "at least one." Additionally, the words "a" and "an" when used in the present document in concert with the words "comprising" or "containing" denote "one or more.

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure. The recitation of numerical ranges by endpoints includes all numbers within that range (e.g. 1 to 5 includes 1, 1.5, 2, 2.75, 3, 3.80, 4, and 5). All dimensions given herein are by way of examples to better illustrate the present disclosure embodiments and shall not be construed to limit the dimensions of the present disclosure embodiments to the given numeric values.

Overview

Figure 2:
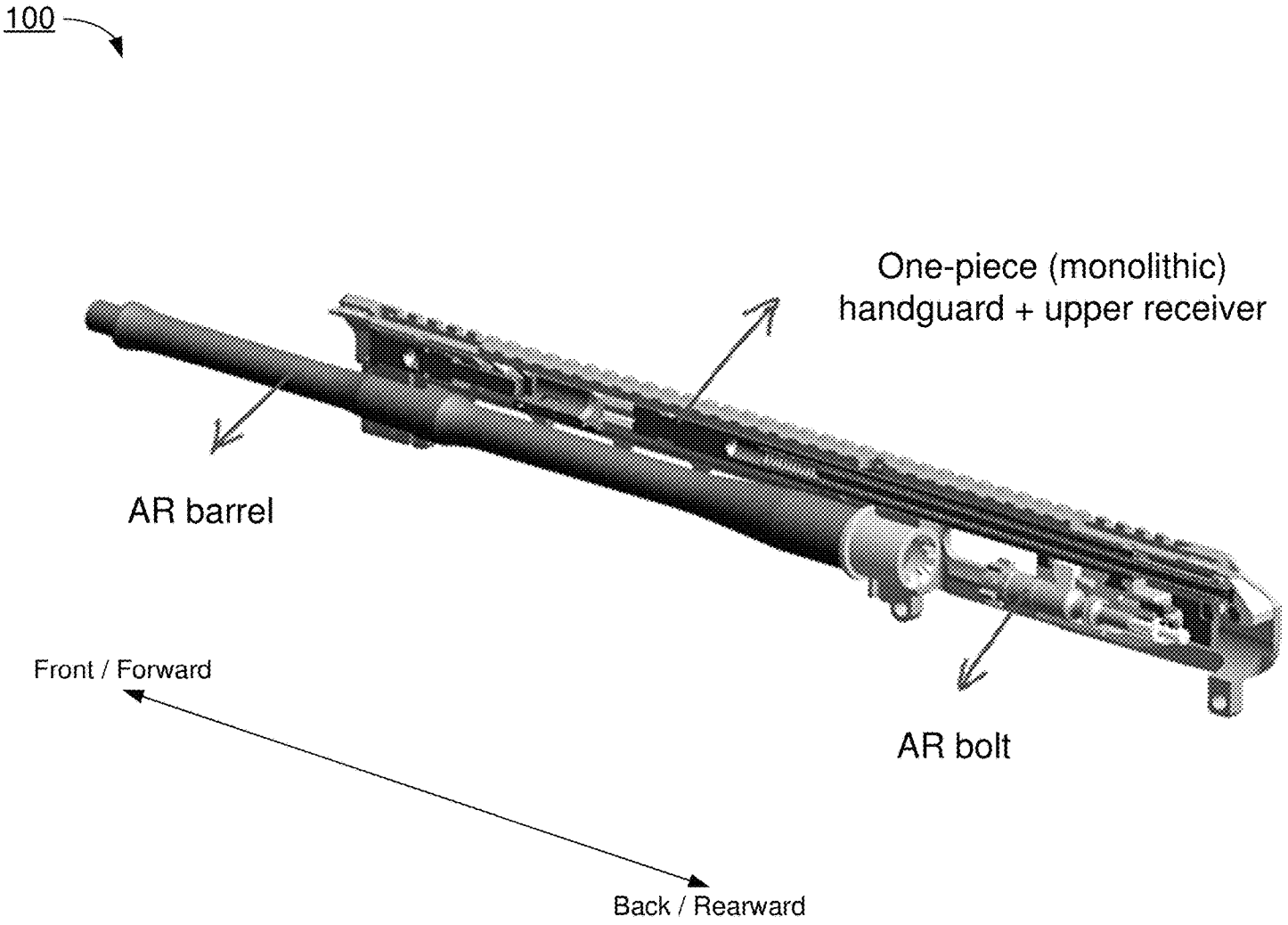
FIG. 2 is a diagram of a monolithic upper receiver in accordance with an implementation of the present disclosure.

FIG. 1 and FIG. 2 illustrate a monolithic upper receiver 100 in accordance with an implementation of the present disclosure. Referring to FIG. 1 and FIG. 2, monolithic upper receiver 100 may include a one-piece receiver that includes an upper receiver portion and a handguard portion which correspond to an upper receiver and a handguard of a conventional AR-15 or AR-10 firearm, respectively. Under a proposed scheme in accordance with the present disclosure, various internal dimensions of the handguard portion of monolithic upper receiver 100 may be configured to receive or otherwise accommodate standard AR barrel (e.g., a mid-length AR barrel such as an 18-inch AR barrel) with standard AR barrel extension. Additionally, various internal dimensions of the upper receiver portion of monolithic upper receiver 100 may be configured to receive or otherwise accommodate mil-spec AR BCG having, for example, a mil-spec bolt carrier, a mil-spec AR bolt head, a mil-spec cam pin assembly, and a mil-spec AR firing pin. Accordingly, a user may replace the upper receiver and the handguard, as two separate components, with monolithic upper receiver 100 and still use the original AR barrel and BCG. Advantageously, this may be a cost-effective solution for a user desiring to replace his/her standard upper receiver and handguard with monolithic upper receiver 100 without also replacing the original AR barrel and BCG. This would also allow the user to utilize the spare parts amply available on the market.

Figure 3:
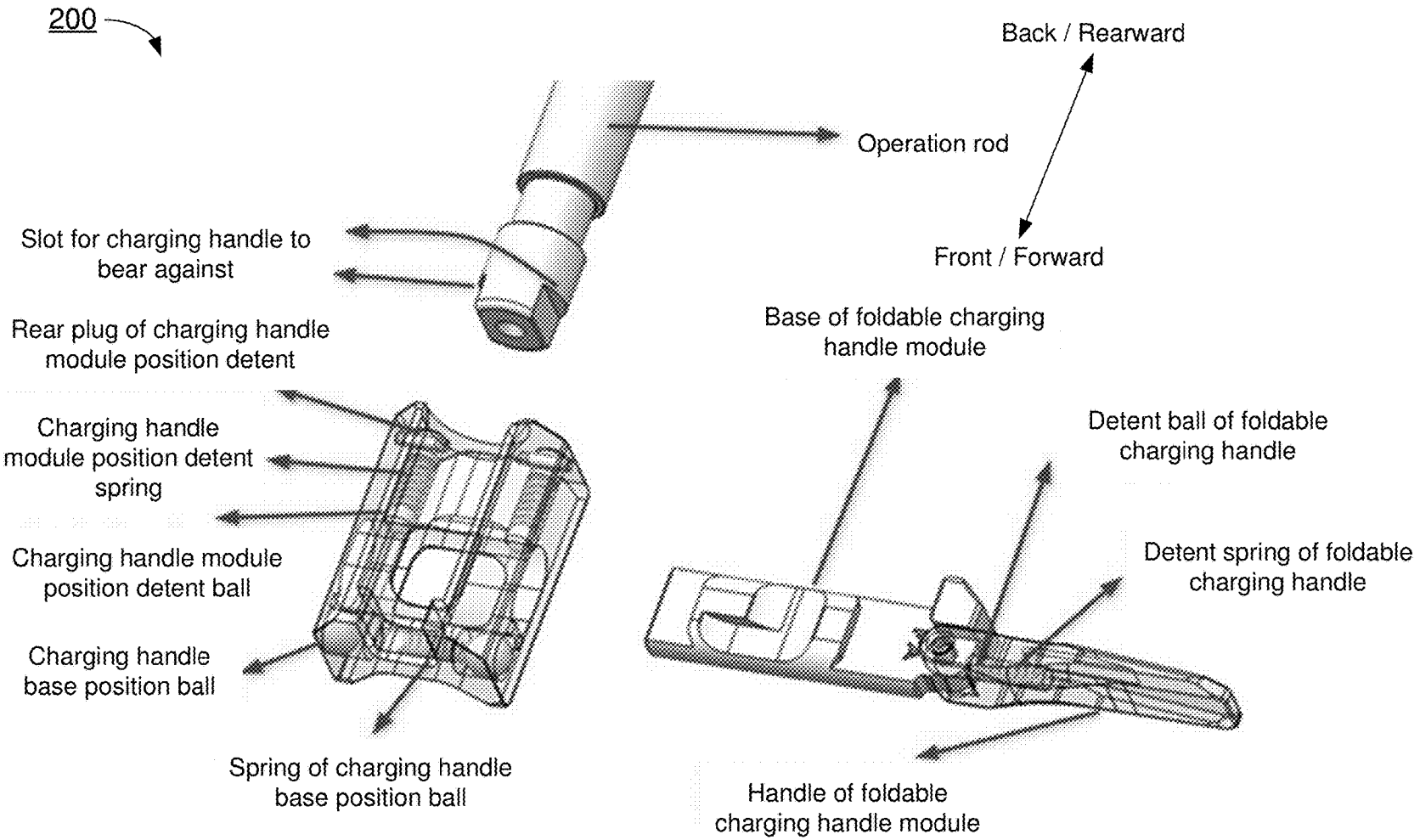
FIG. 3 is a diagram of a forward assist in accordance with an implementation of the present disclosure.
Figure 4:
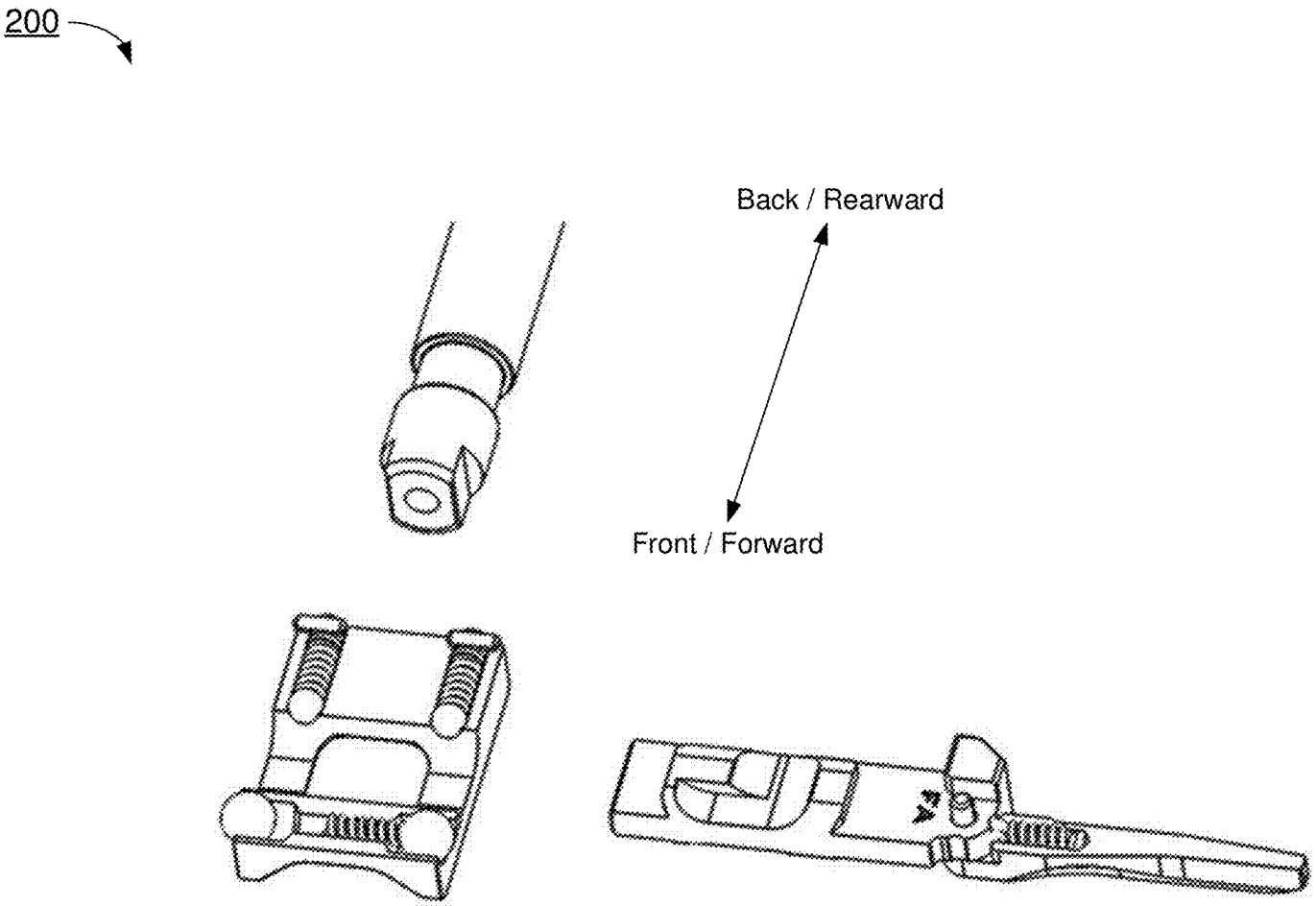
FIG. 4 is a diagram of a forward assist in accordance with an implementation of the present disclosure.
Figure 5:
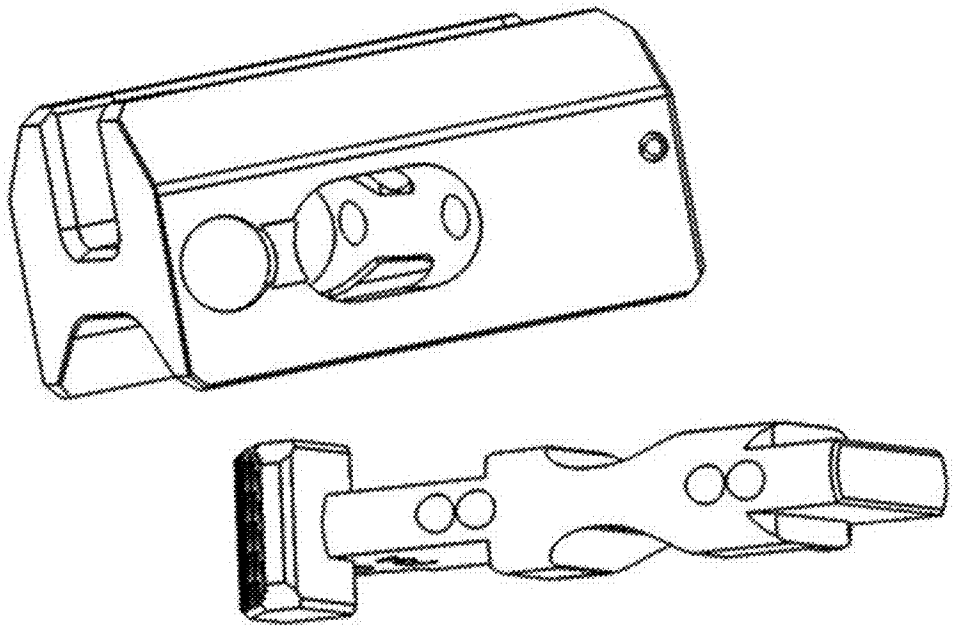
FIG. 5 is a diagram of a forward assist in accordance with an implementation of the present disclosure.
Figure 6:
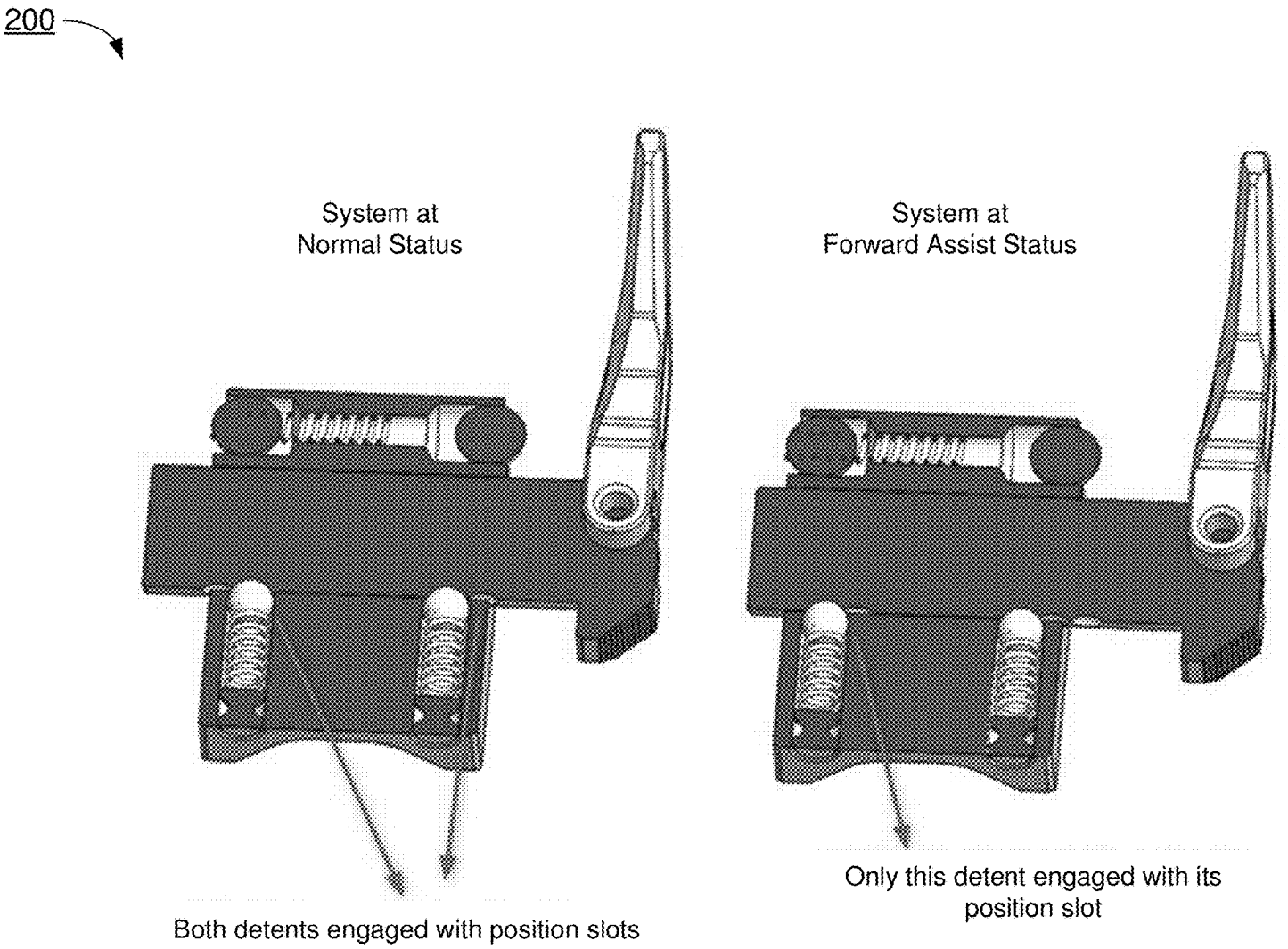
FIG. 6 is a diagram of a forward assist in accordance with an implementation of the present disclosure.
Figure 7:
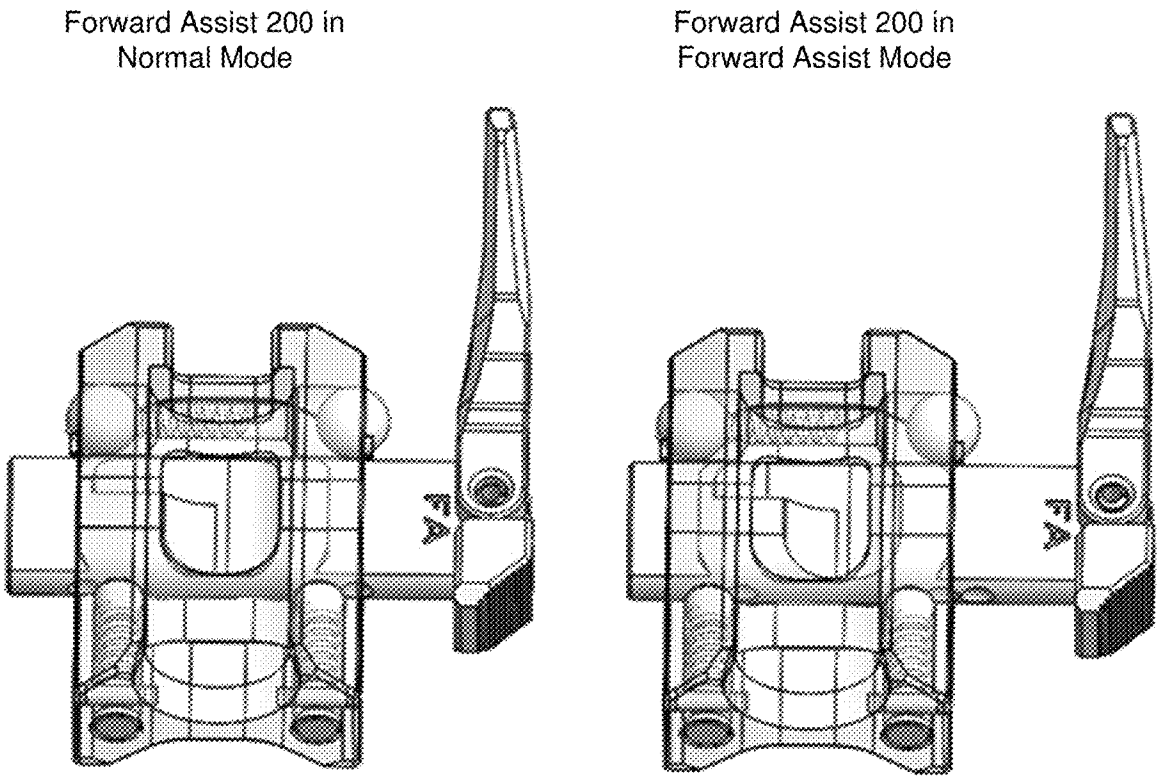
FIG. 7 is a diagram of a forward assist in accordance with an implementation of the present disclosure.
Figure 8:
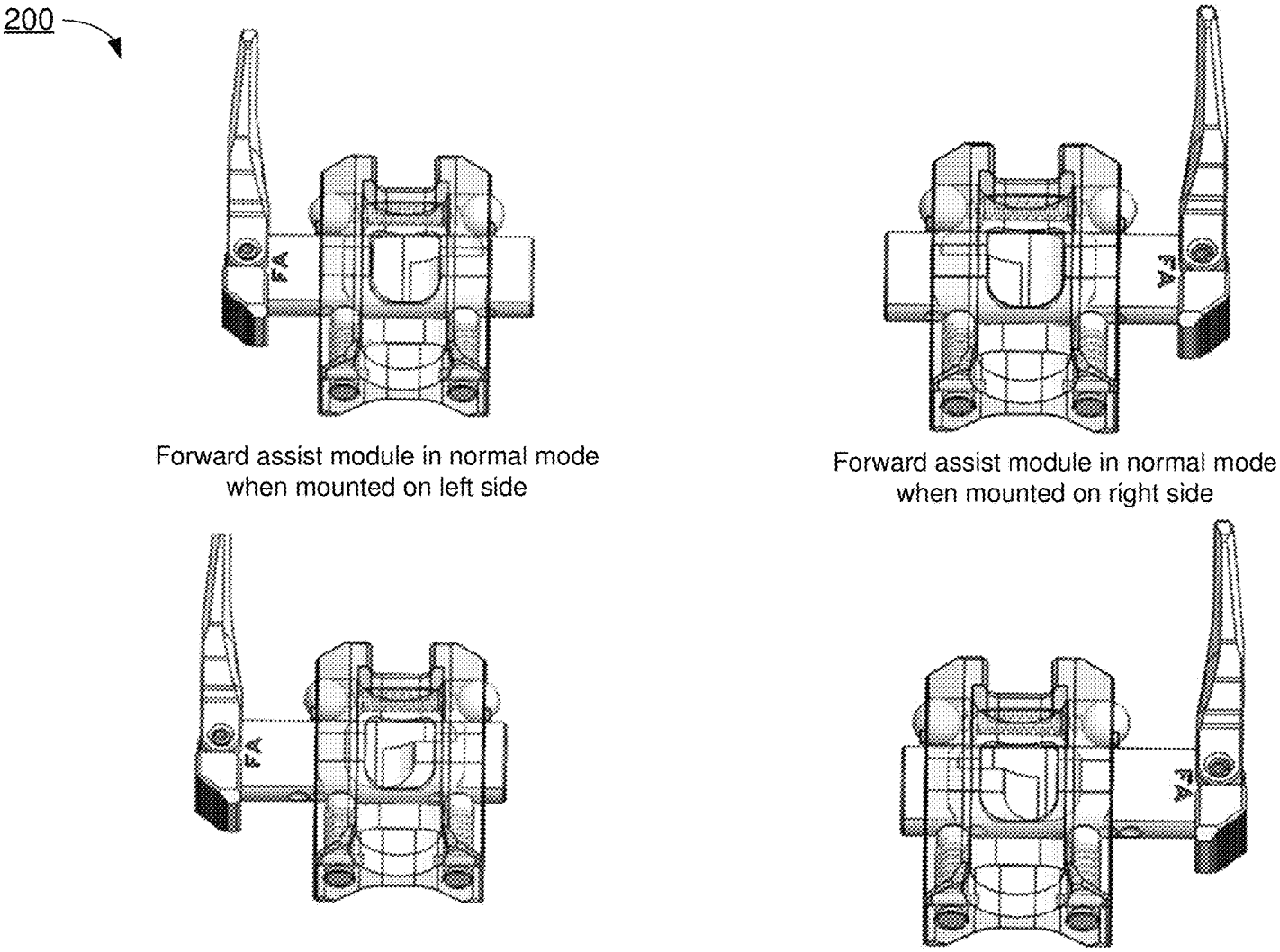
FIG. 8 is a diagram of a forward assist in accordance with an implementation of the present disclosure.
Figure 9:
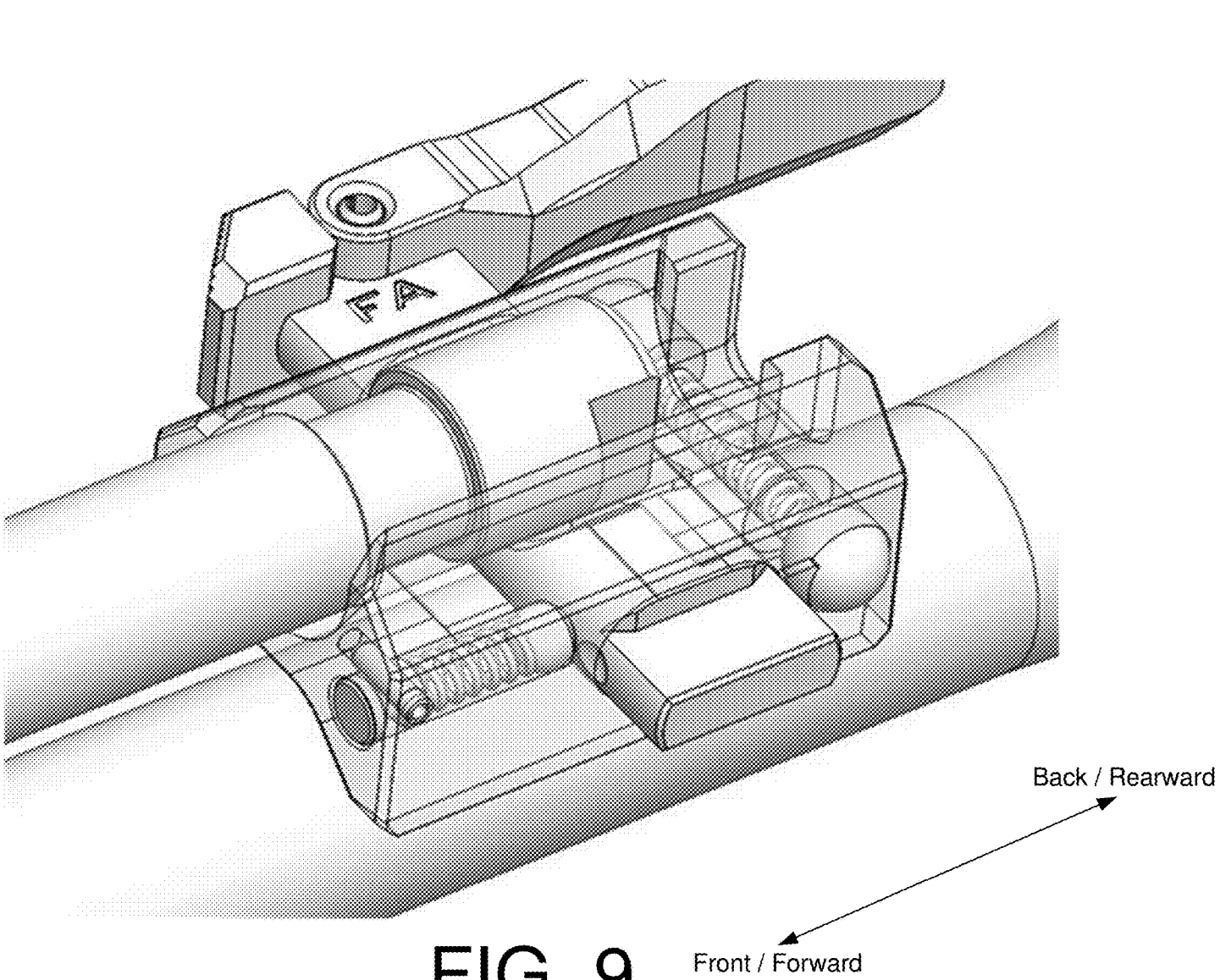
FIG. 9 is a diagram of a forward assist in accordance with an implementation of the present disclosure.
Figure 10:
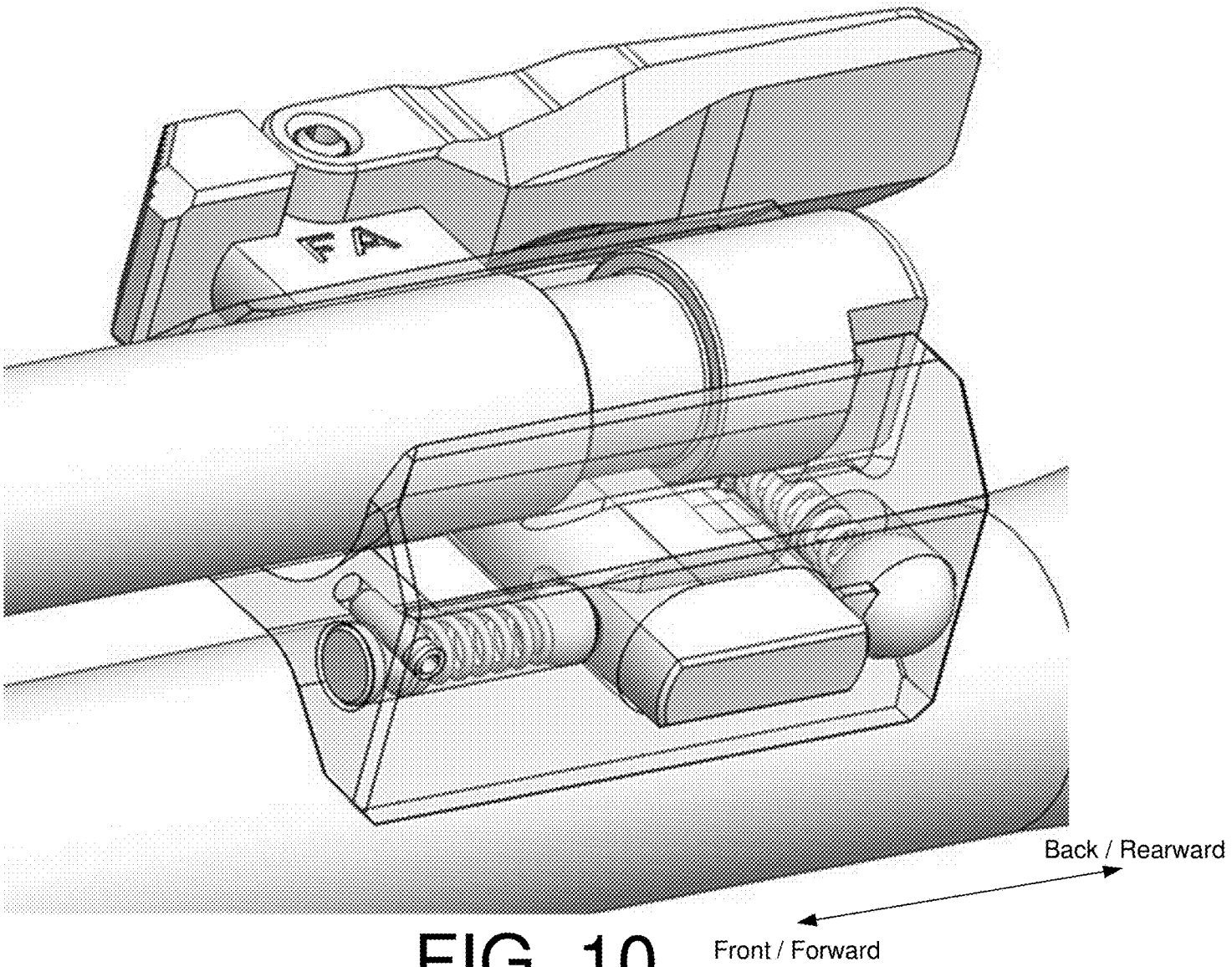
FIG. 10 is a diagram of a forward assist in accordance with an implementation of the present disclosure.
Figure 11:
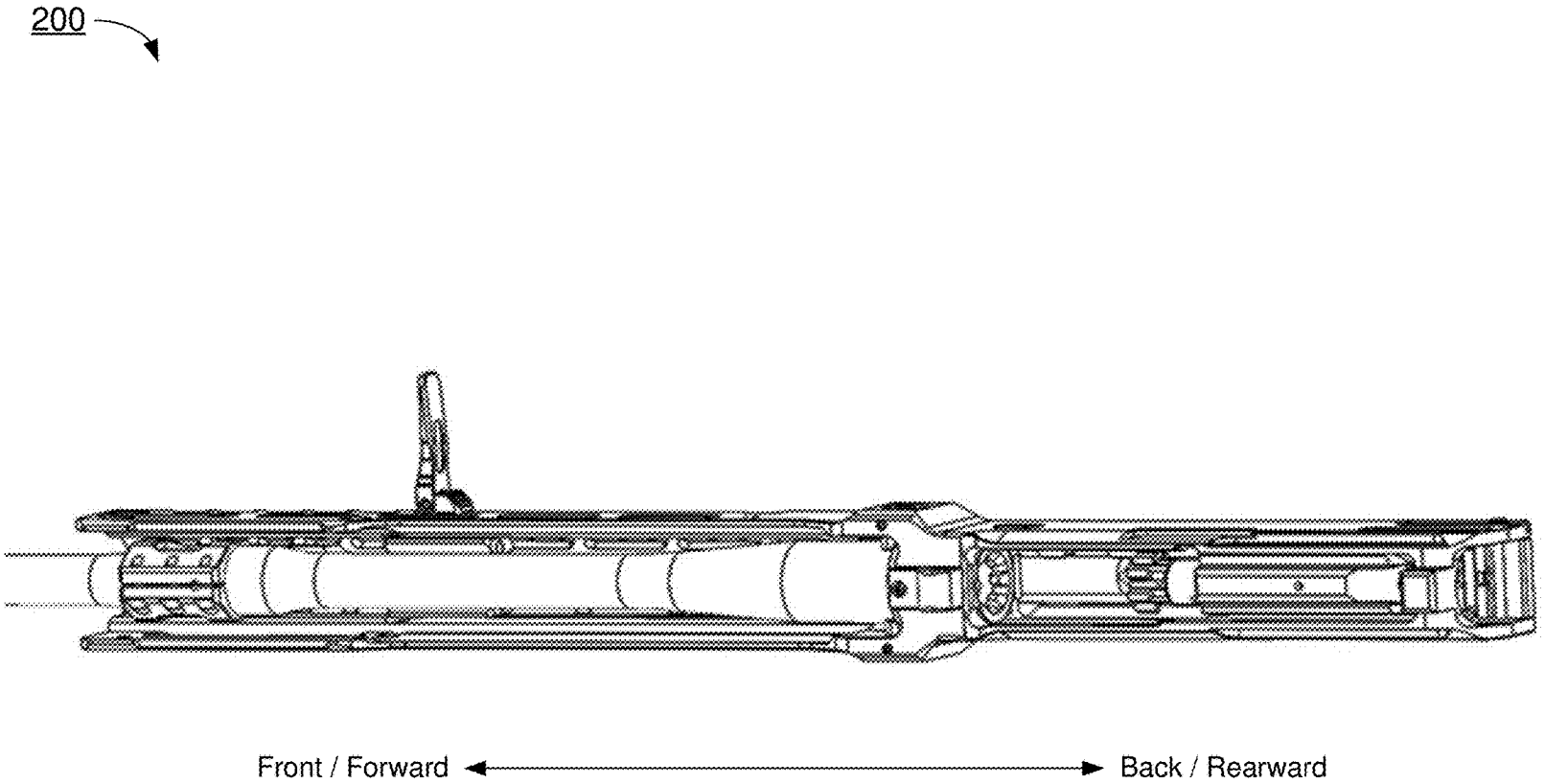
FIG. 11 is a diagram of a forward assist in operation in accordance with an implementation of the present disclosure.
Figure 12:
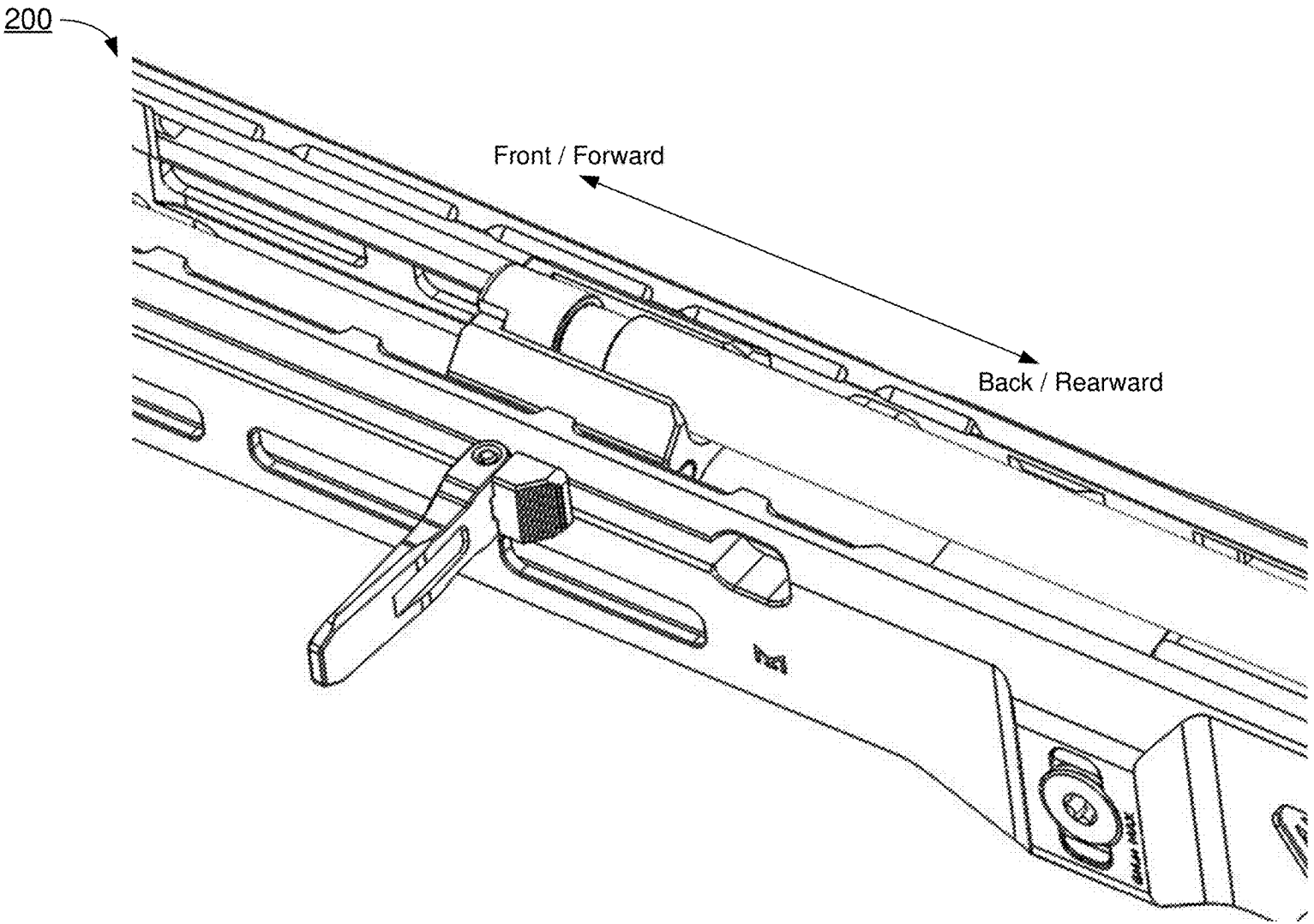
FIG. 12 is a diagram of a forward assist in operation in accordance with an implementation of the present disclosure.
Figure 13:
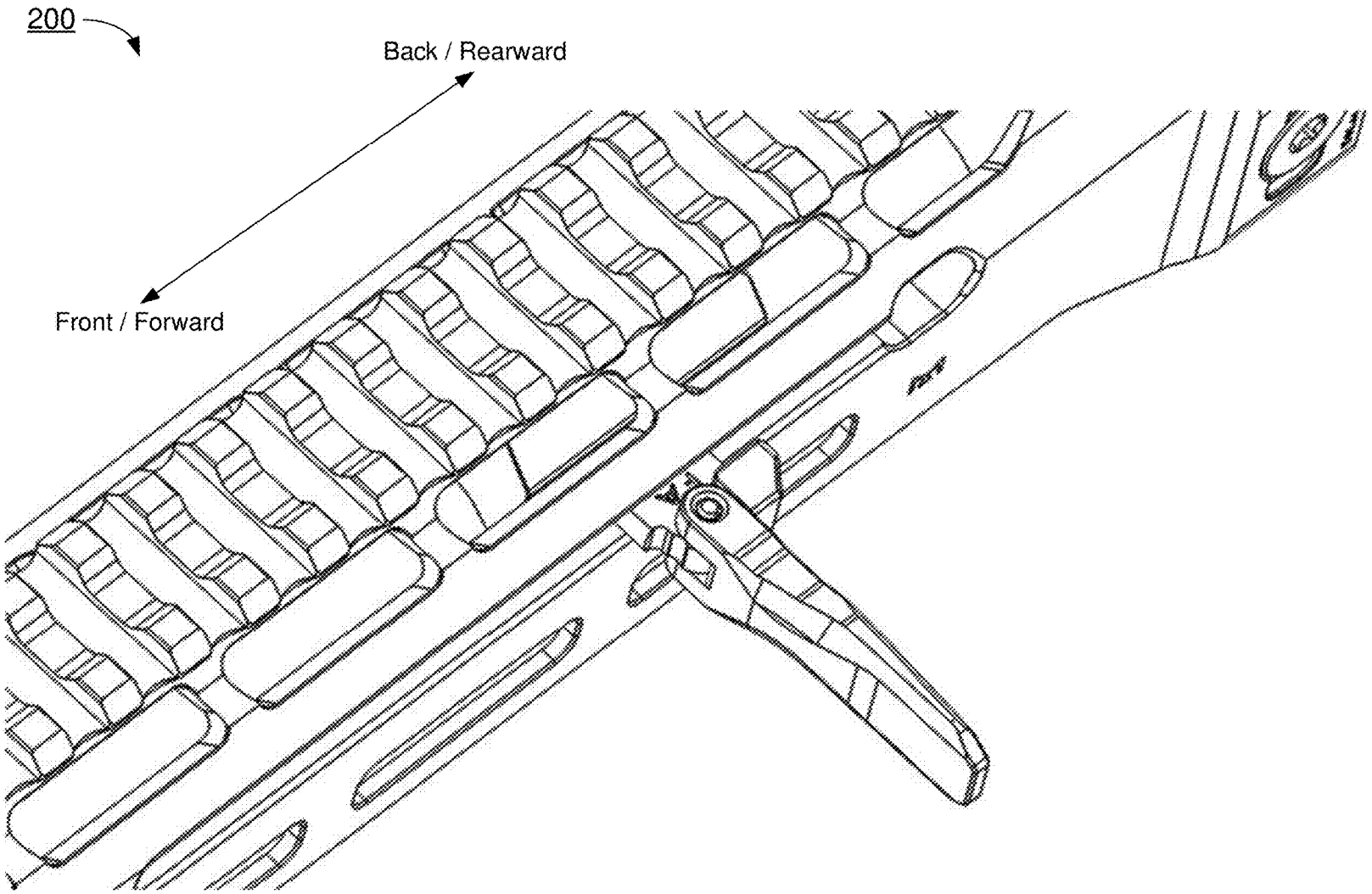
FIG. 13 is a diagram of a forward assist in operation in accordance with an implementation of the present disclosure.
Figure 14:
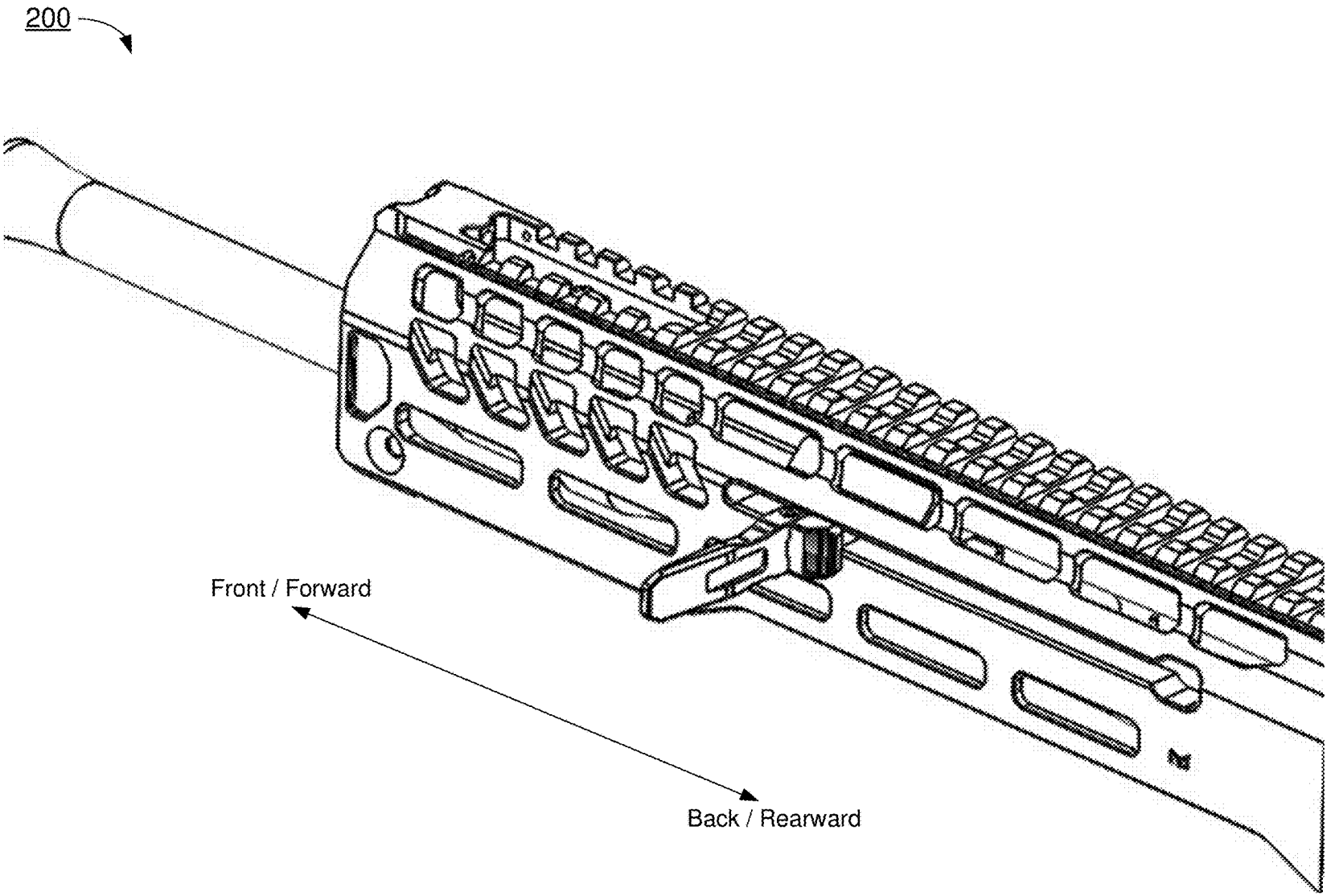
FIG. 14 is a diagram of a forward assist in operation in accordance with an implementation of the present disclosure.
Figure 15:
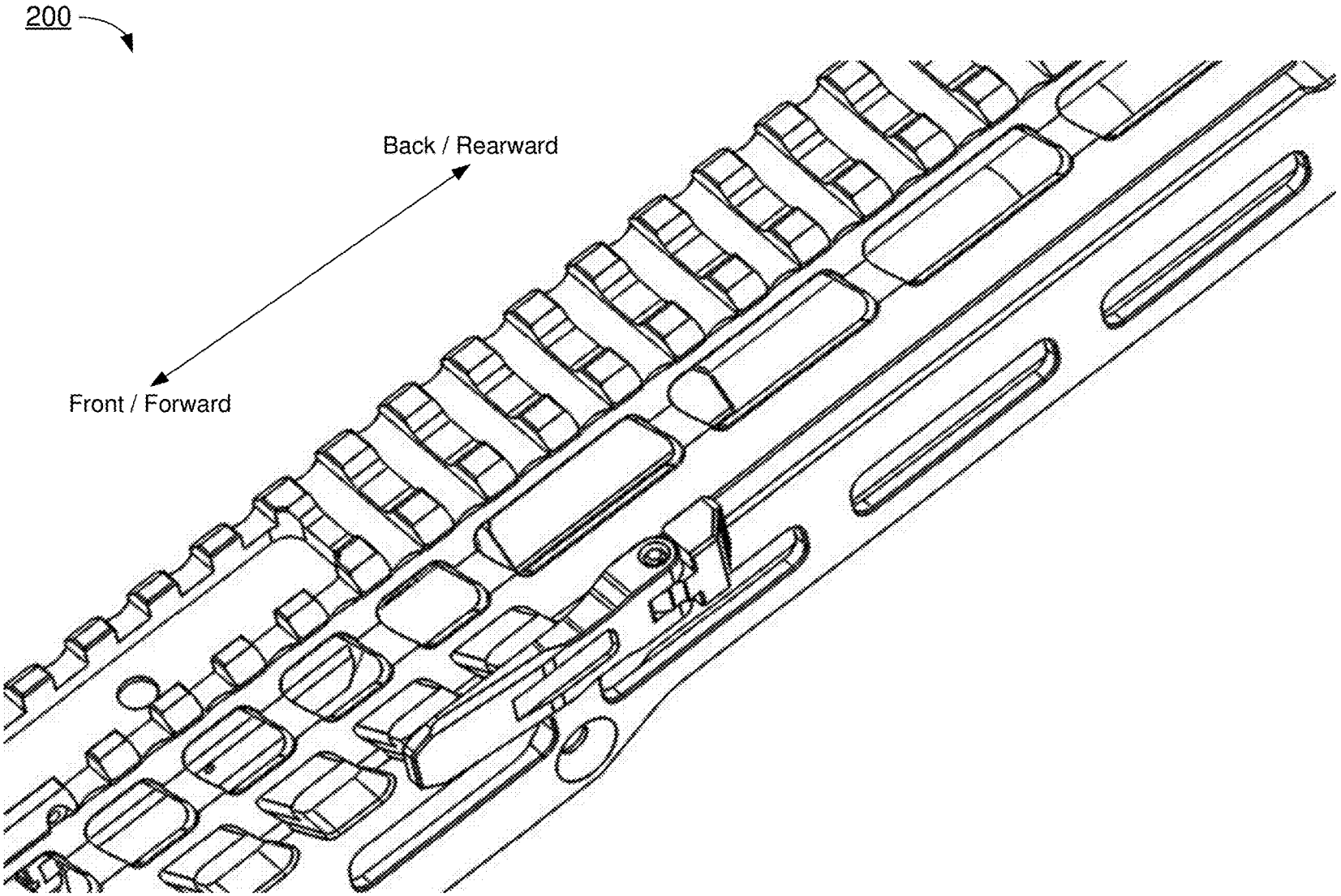
FIG. 15 is a diagram of a forward assist in operation in accordance with an implementation of the present disclosure.

FIG. 3~FIG. 10 illustrate a charging handle assembly 200 in accordance with an implementation of the present disclosure. FIG. 11~FIG. 15 illustrate charging handle assembly 200 in operation in accordance with an implementation of the present disclosure. Specifically, each of FIG. 3 and FIG. 4 shows components of an ambidextrous charging handle assembly 200. FIG. 5 shows a detent on an assembly base of charging handle assembly 200 and corresponding indents/dimples/concaves on a base of a foldable charging handle of charging handle assembly 200. Each of FIG. 6 and FIG. 7 shows charging handle assembly 200 in a normal mode and in a forward assist mode. FIG. 8 shows charging handle assembly 200 in a normal mode and in a forward assist mode when foldable charging handle is mounted on the left side and the right side of the firearm, respectively. FIG. 9 shows an operating rod of the firearm clear to pass (e.g., not engaged with charging handle assembly 200) when charging handle assembly 200 is in the normal mode. FIG. 10 shows the operating rod engaged with charging handle assembly 200 when charging handle assembly 200 is in the forward assist mode. FIG. 11~FIG. 15 illustrate an operation of charging handle assembly 200. In FIG. 11, the BCG of the firearm may be stuck in a middle of travel during cycling. In FIG. 12, a user may rack charging handle assembly 200 backwardly toward the back side of the firearm until it contacts with a bearing surface on the operating rod. In FIG. 13, the user may place charging handle assembly 200 in the forward assist mode, with the foldable charging handle unfolded or otherwise pulled out to extend or point outwardly. In FIG. 14, the user may drag the BCG forward by racking charging handle assembly 200 forward after the charging handle assembly 200 enters the forward assist mode. In FIG. 15, the user may tap or otherwise fold the foldable charging handle inwardly (e.g., toward the barrel) to disengage from the operating rod and place charging handle assembly 200 in the normal mode.

Referring to FIG. 3~FIG. 15, charging handle assembly 200 may have all necessary components built inside a charging handle module thereof. Additionally, unlike a conventional forward assist, charging handle assembly 200 may be configured to operate with an operating rod (or op rod, which is a connecting rod between a piston and the bolt carrier of the firearm) at the front of the upper receiver portion of monolithic upper receiver 100. This design not only would allow easy access by the support hand of a user, but it also would prevent debris from entering into the working area of the BCG inside monolithic upper receiver 100. Under various proposed designs in accordance with the present disclosure, to avoid accidental trigger of forward assist function, a user would be required to pull out the charging handle module of charging handle assembly 200 to place charging handle assembly 200 in operation. Afterwards, at the end of operation, the user would need to push the charging handle module inwardly to disengage forward assist function of charging handle assembly 200, as it may be relatively easy for the user to accidently hit or push the charging handle module inward and then pull or drag it outward.

Under various proposed designs in accordance with the present disclosure, charging handle assembly 200 may also include a detent system. The detent system may include a metal ball and a spring to constantly exert a force against a working surface. When the working surface is configured with indents (e.g., concaves or dimples), the detent may provide a "click" feeling and sound when being changed from one position to another. Moreover, the indents provide an indexing/positioning function to prevent a screw from becoming loose while the firearm is in use (e.g., firing off round(s) of ammunition). The detent system may be disposed between the charging handle module and the charging handle base of charging handle assembly 200 to ensure the charging handle module would not slide freely to accidently engage charging handle assembly 200 in forward assist mode. Furthermore, the detent system may also provide a positive click feedback as a way for the user to determine whether a setting has been changed correctly. This design ensures that the charging handle can firmly stay at a retracted position for charging handle assembly 200 to be in a normal mode and also can easily return from the forward assist mode (charging handle assembly 200 in operation) to the normal mode (charging handle assembly 200 not in operation). Under some proposed designs, the detent system may be configured to operate with two indents, dimples or concaves engaged while in the normal mode, but only with one indent, dimple or concave engaged while in the forward assist mode. Accordingly, it may be easier for a user to switch charging handle assembly 200 from the forward assist mode to the normal mode than from the normal mode to the forward assist mode.

Advantageously, the proposed designs of charging handle assembly 200 do away with having an independent forward assist assembly at a side of the upper receiver as in the conventional design, thereby providing a sleek and clean receiver design. Moreover, the proposed designs of charging handle assembly 200 would not require any serrations or cuts on the bolt carrier, thereby lowering the cost of manufacturing and reducing likelihood of debris entering into the receiver. Furthermore, with the proposed designs of charging handle assembly 200, a user can easily access and operate charging handle assembly 200 with his/her support hand while under a ready status (e.g., keeping his/her strong hand on the firearm to be ready to pull the trigger).

Figure 16:
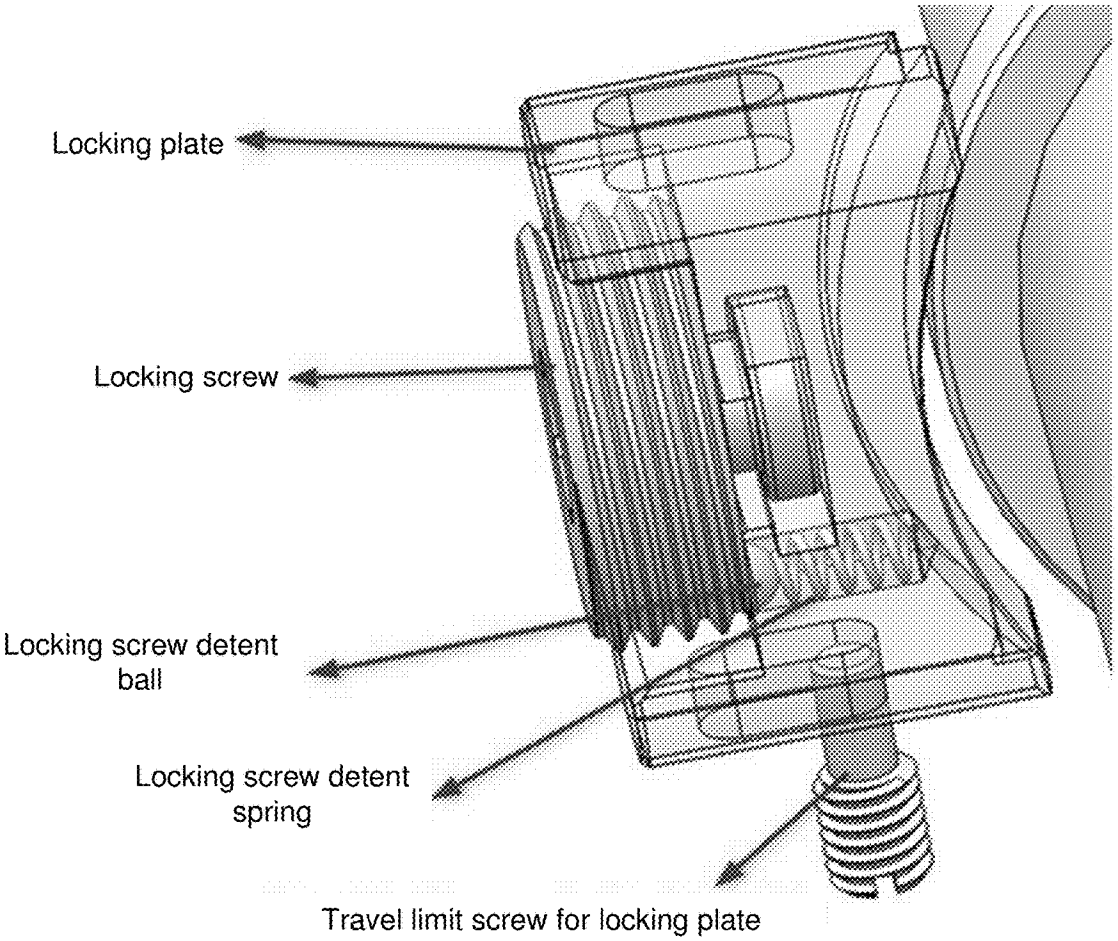
FIG. 16 is a diagram of a barrel locking system in accordance with an implementation of the present disclosure.
Figure 17:
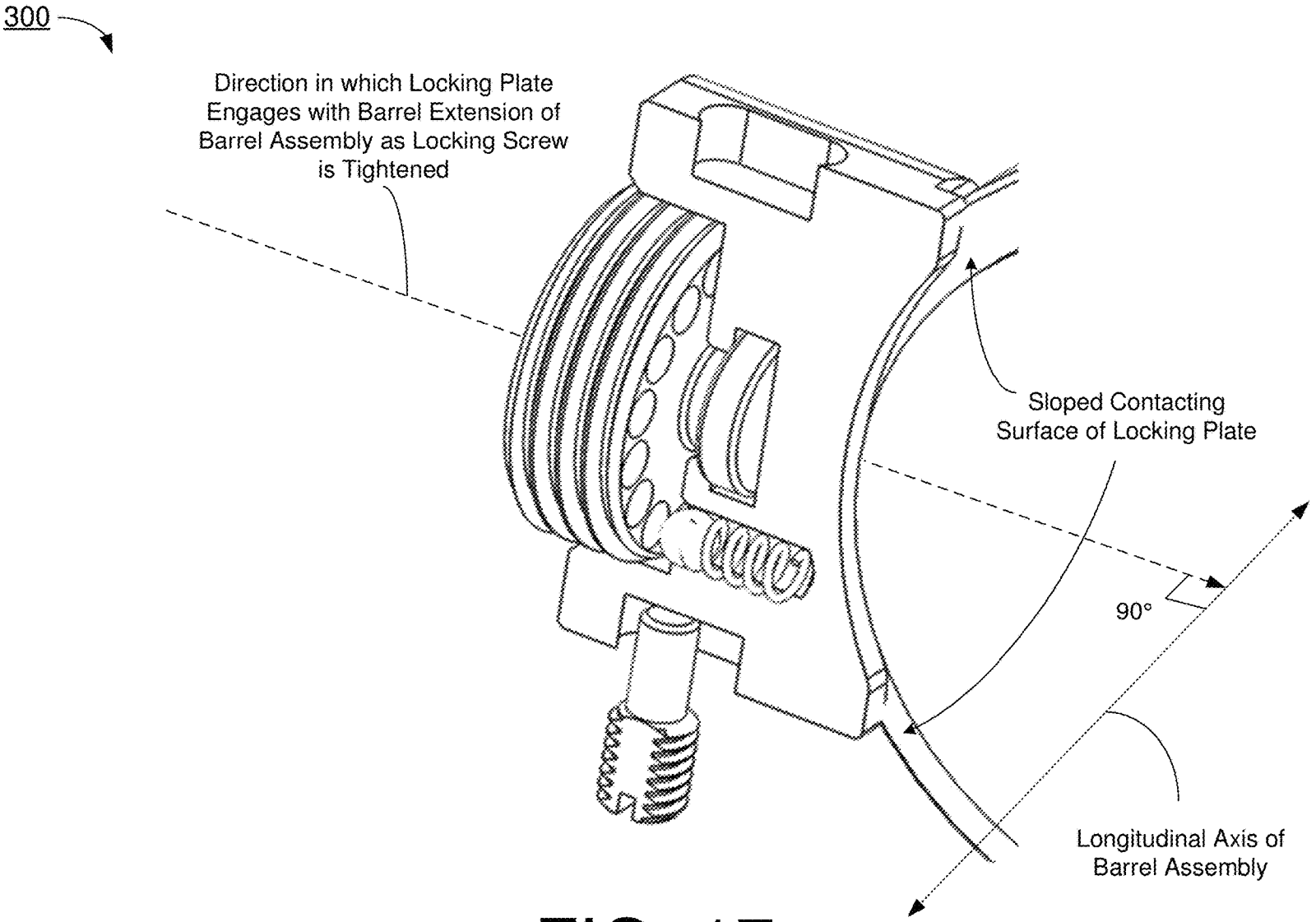
FIG. 17 is a diagram of a barrel locking system in accordance with an implementation of the present disclosure.
Figure 18:
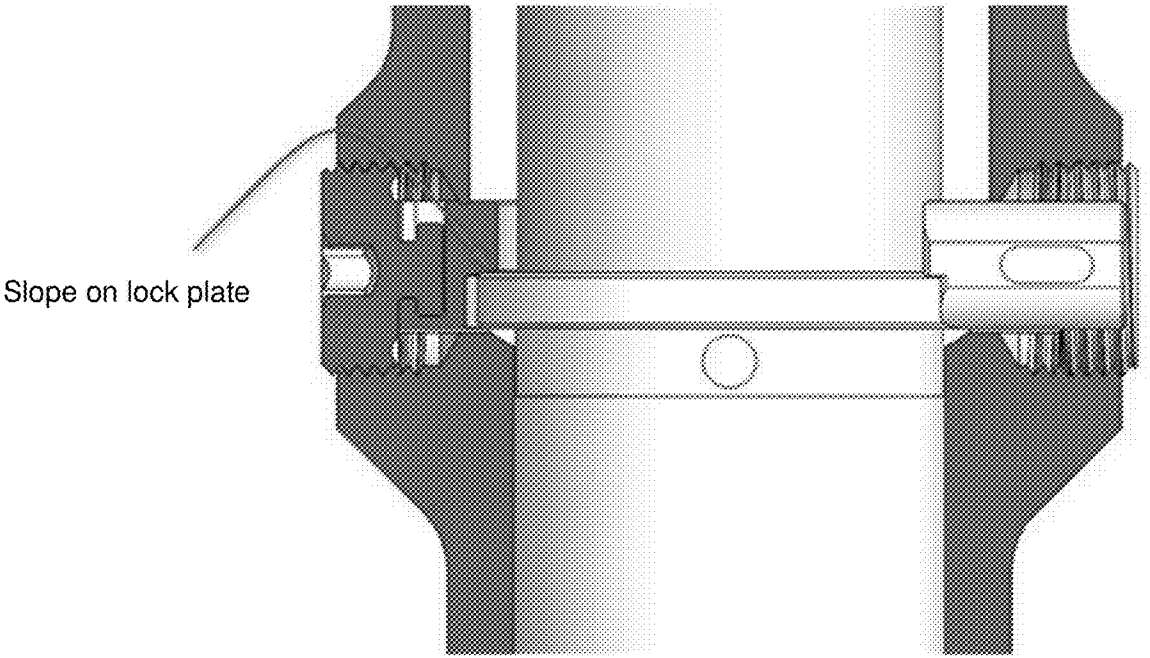
FIG. 18 is a diagram of a barrel locking system in accordance with an implementation of the present disclosure.
Figure 19:
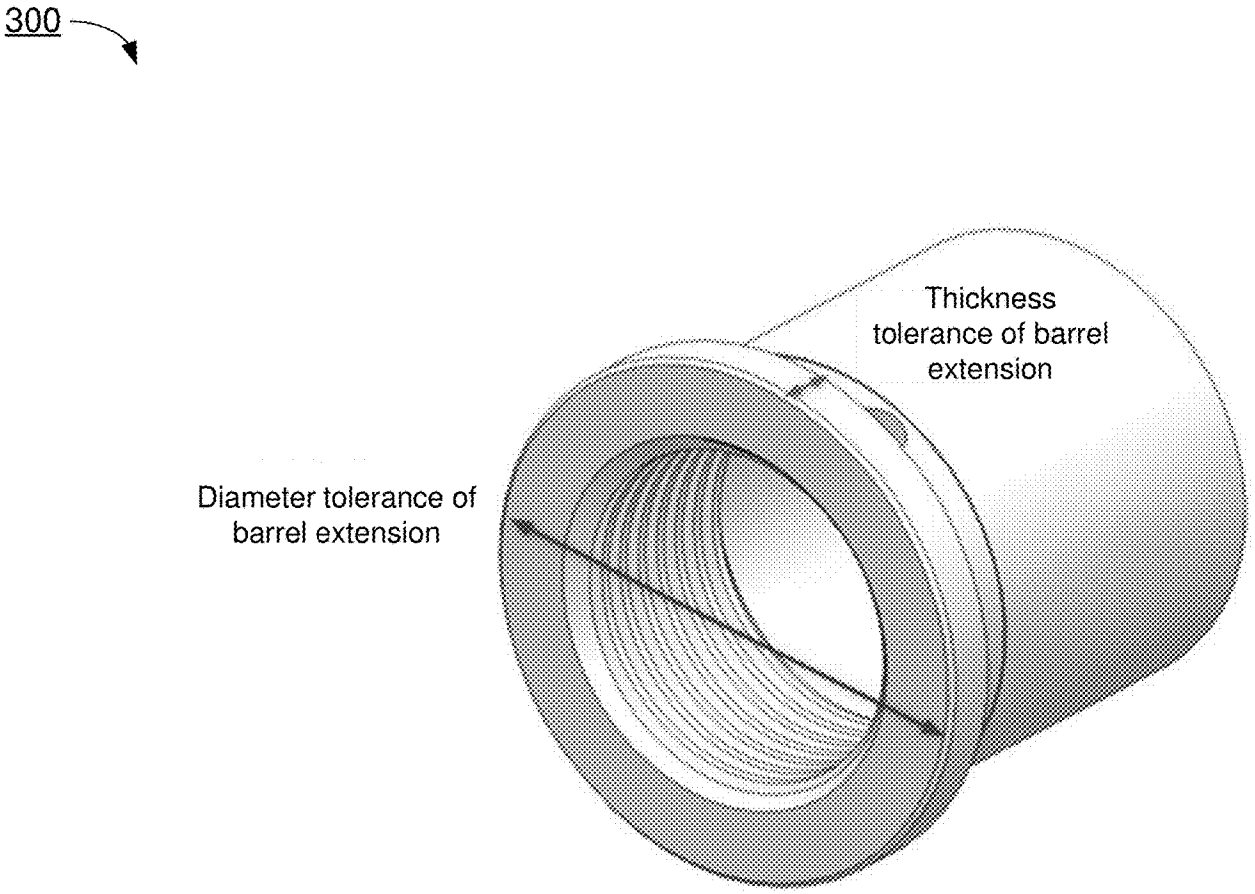
FIG. 19 is a diagram of a barrel locking system in accordance with an implementation of the present disclosure.
Figure 20:
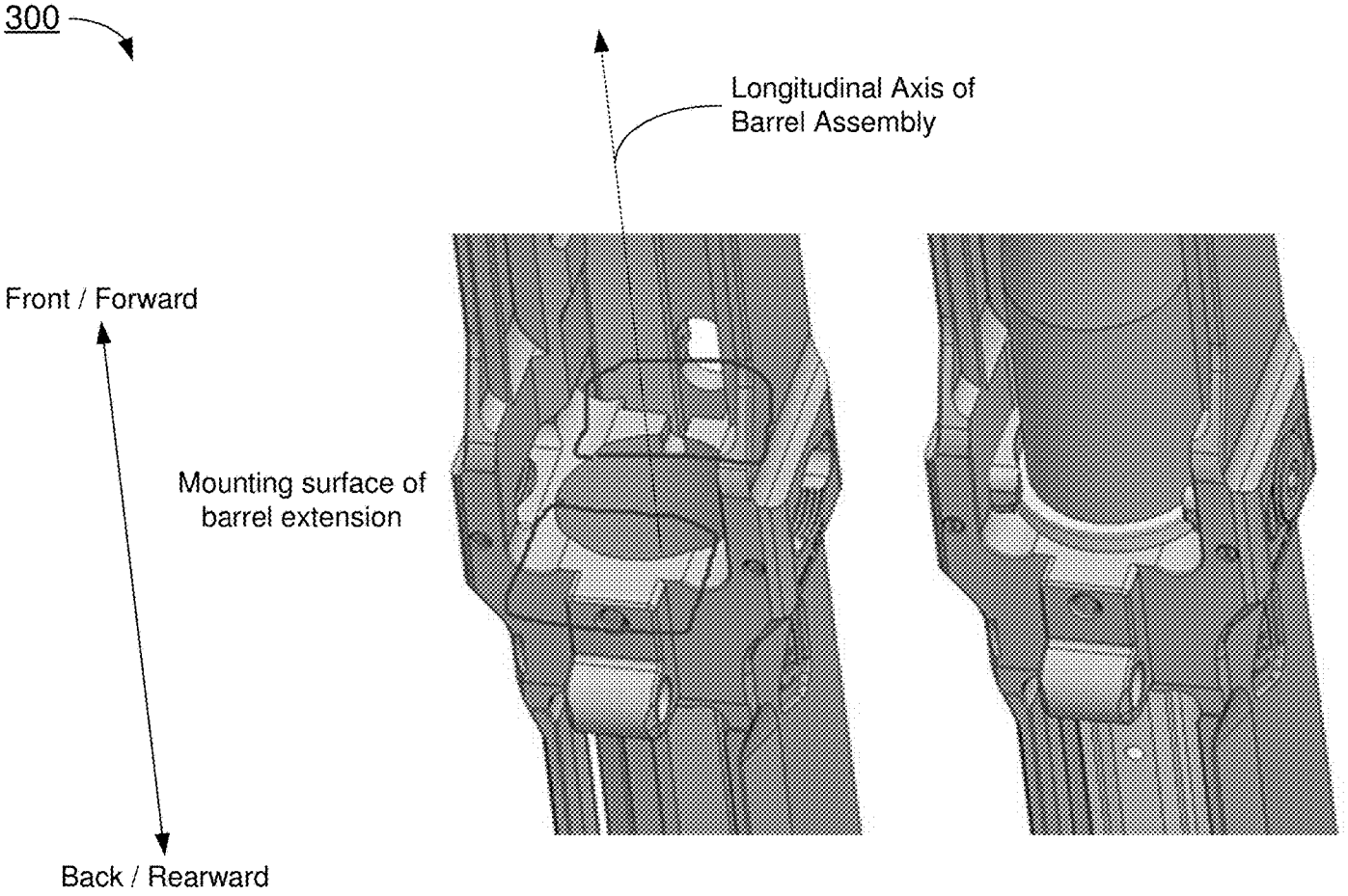
FIG. 20 is a diagram of a barrel locking system in accordance with an implementation of the present disclosure.
Figure 21:
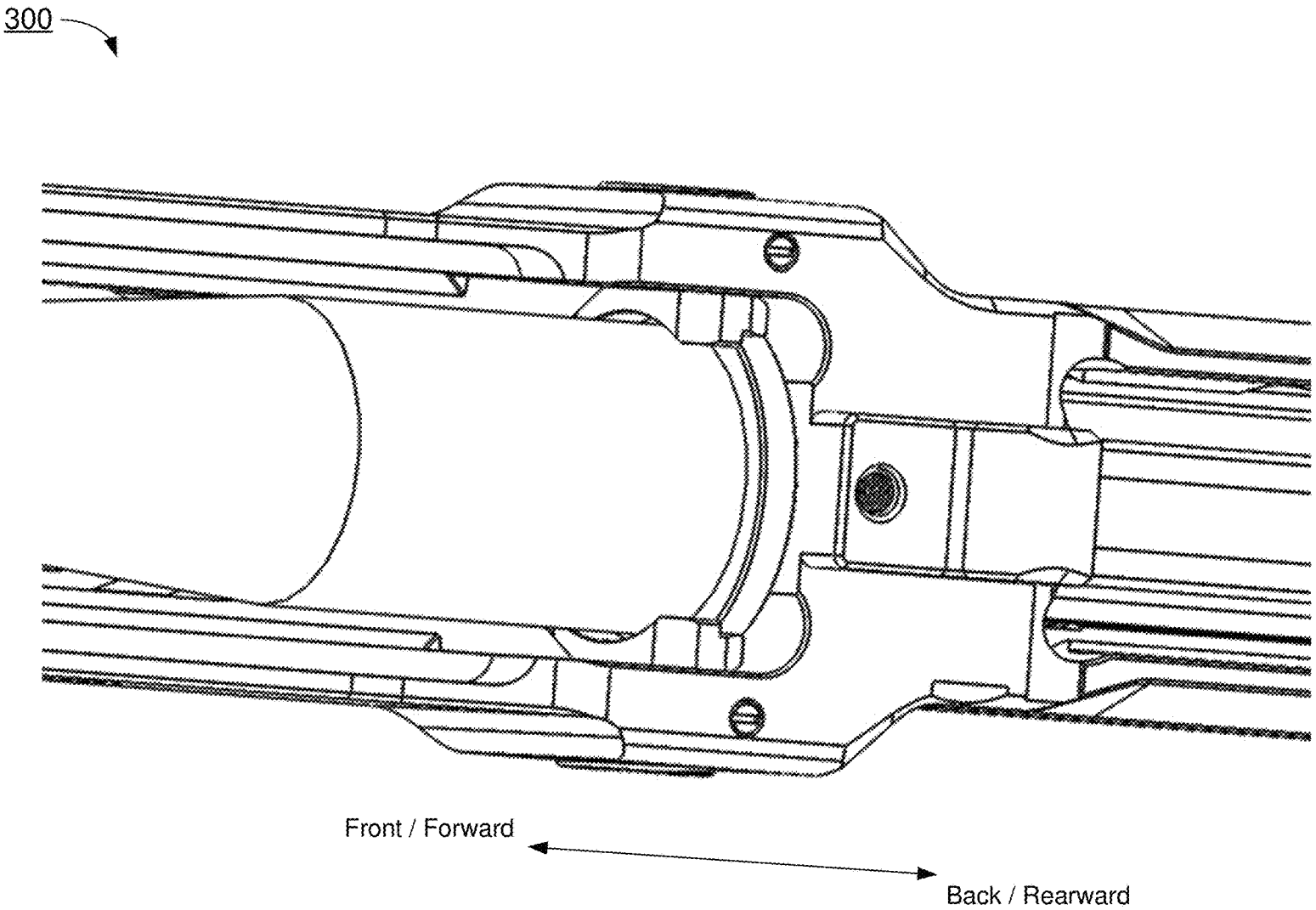
FIG. 21 is a diagram of a barrel locking system in operation in accordance with an implementation of the present disclosure.
Figure 22:
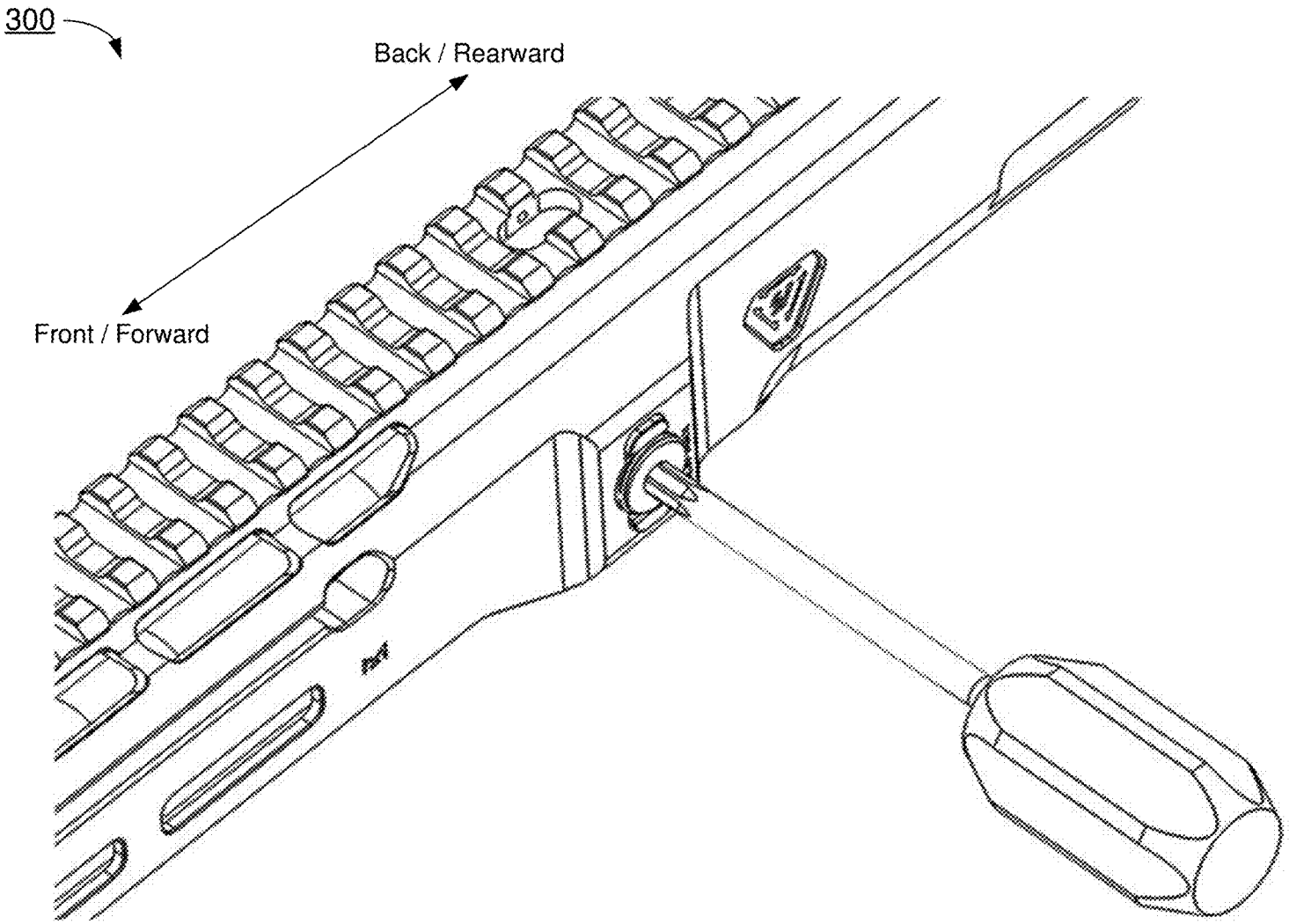
FIG. 22 is a diagram of a barrel locking system in operation in accordance with an implementation of the present disclosure.
Figure 23:
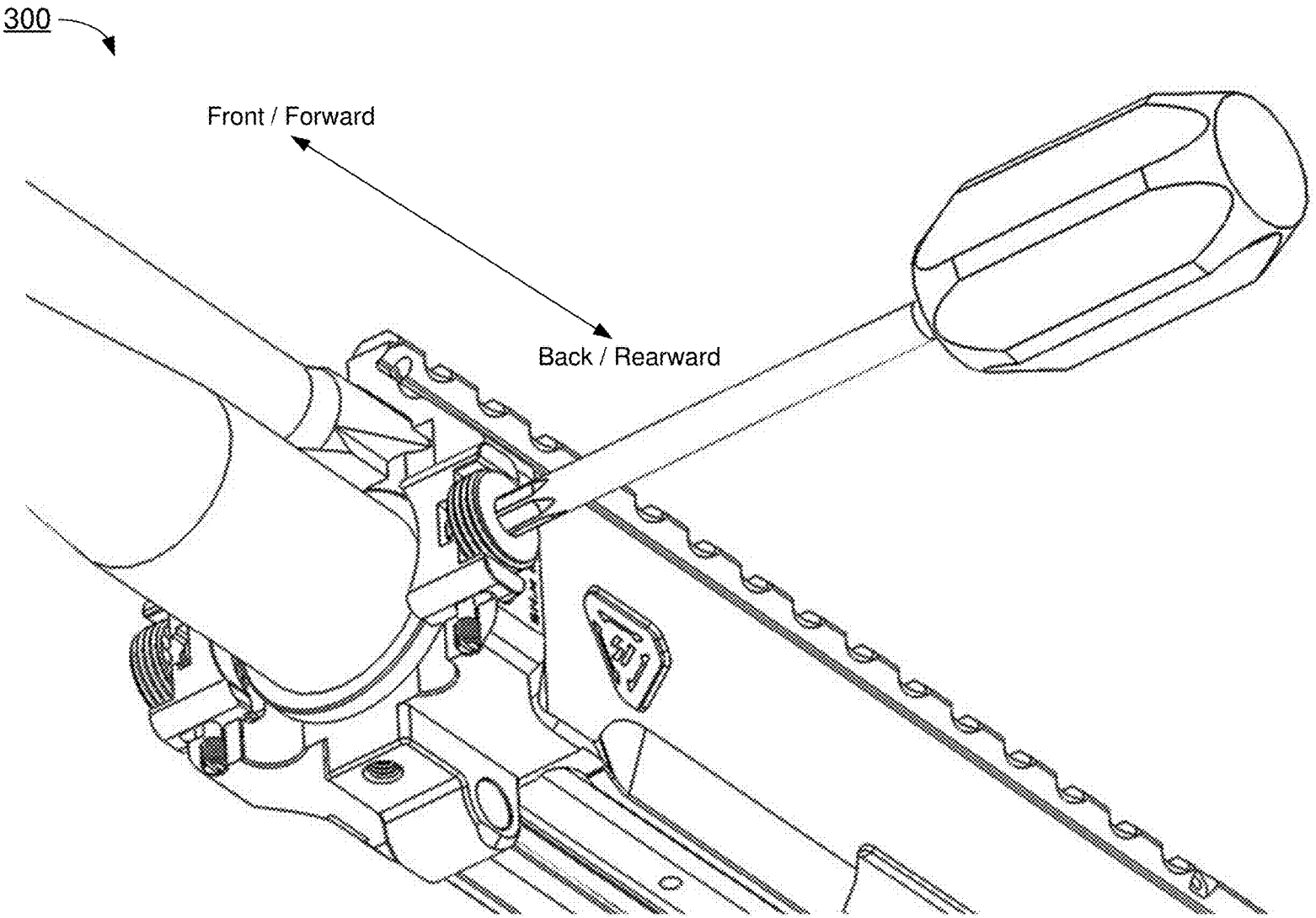
FIG. 23 is a diagram of a barrel locking system in operation in accordance with an implementation of the present disclosure.
Figure 24:
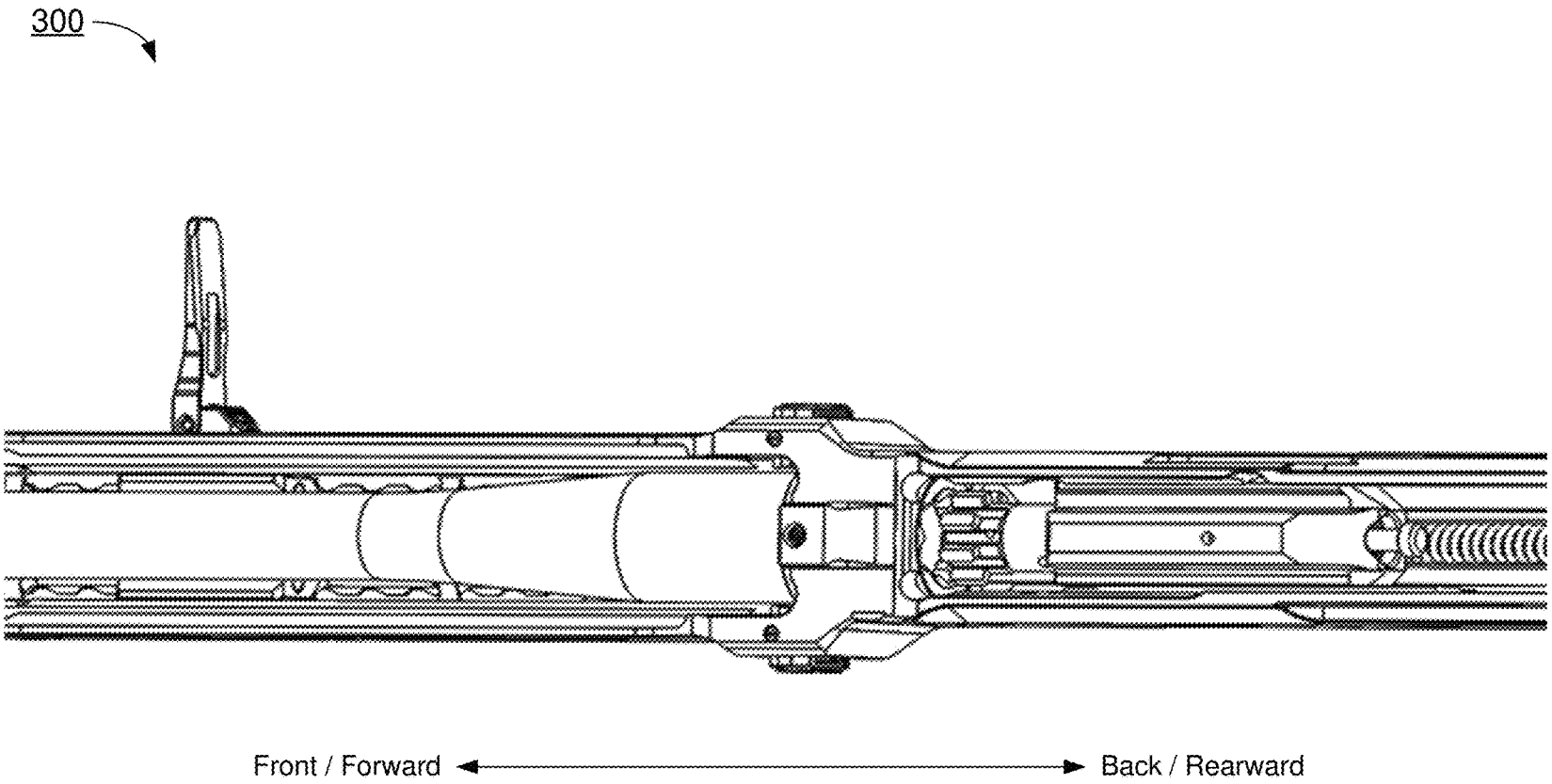
FIG. 24 is a diagram of a barrel locking system in operation in accordance with an implementation of the present disclosure.
Figure 25:
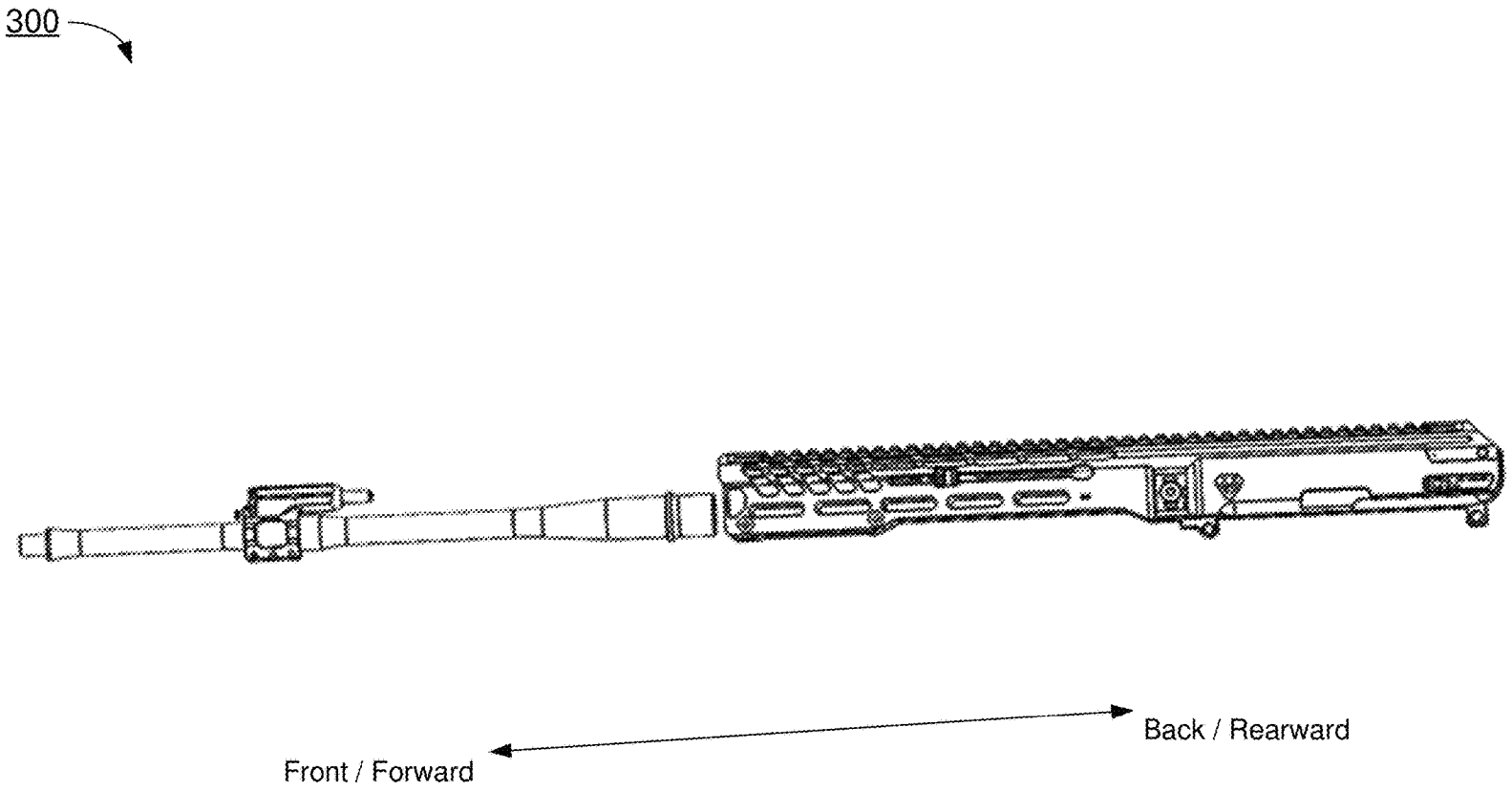
FIG. 25 is a diagram of a barrel locking system in operation in accordance with an implementation of the present disclosure.

FIG. 16~FIG. 20 illustrate a barrel locking system 300 in accordance with an implementation of the present disclosure. FIG. 21~FIG. 25 illustrate barrel locking system 300 in operation in accordance with an implementation of the present disclosure. Specifically, each of FIG. 16 and FIG. 17 shows various components of barrel locking system 300 which may include, for each of left and right sides of a barrel assembly of the firearm, a locking plate, a barrel locking screw, a barrel locking screw detent ball, a barrel locking screw detent spring, and a travel-limit screw. FIG. 18 shows a specially-designed slope on the locking plate. FIG. 19 shows a diameter tolerance of a barrel extension as well as a thickness tolerance of the barrel extension, to which the slope on the locking plate is designed to adapt. FIG. 20 shows mounting surfaces of monolithic upper receiver 100 that come in direct contact with a rim of the barrel extension of the barrel assembly. FIG. 21~FIG. 25 illustrate an operation of charging handle assembly 200. In FIG. 21, a barrel of the firearm is under a locking status. In FIG. 22, a user may use a screwdriver to loosen a barrel locking screw of barrel locking system 300. In FIG. 23, the barrel locking screw may be unscrewed or otherwise loosen to allow locking plate to be disengaged or otherwise pulled away from the barrel extension of the barrel assembly up to an extent at which the locking plate is stopped by a corresponding travel-limit screw. In FIG. 24, the BCG may be charged back from a locked status. In FIG. 25, the user may slide the barrel assembly out of monolithic upper receiver 100.

Referring to FIG. 16~FIG. 25, barrel locking system 300 may allow a barrel assembly to be mounted on and removed from monolithic upper receiver 100 (or another one-piece upper receiver) without removal of a handguard (e.g., even a lower handguard). Under various proposed designs in accordance with the present disclosure, barrel locking system 300 may include a locking plate assembly and two barrel locking screws on two opposite sides (e.g., left side and right side) that, together, provide an easy access for the user to mount and remove the barrel without removal of any part prior to or in order for access to the barrel. Barrel locking system 300 may also include a built-in detent which may provide a positive feedback to the user when operating the barrel locking screw(s) in addition to preventing the barrel locking screws from becoming loose. Barrel locking system 300 may further include a travel-limit screw which may prevent a corresponding barrel locking screw from being accidentally pulled out by the user when handling or operating the firearm. Under various proposed designs in accordance with the present disclosure, a locking plate of the locking plate assembly may be configured with a slope to allow the locking plate to adapt to different tolerances in diameter and thickness of a barrel extension of the barrel assembly. In addition, the slope may provide or otherwise exert a force to firmly secure the barrel extension on a mounting surface on the interior of monolithic upper receiver 100.

Advantageously, the locking plate system 300 may allow a barrel assembly to be mounted on and removed from a one-piece upper receiver, such as monolithic upper receiver 100, without the need of removal of a handguard (e.g., even just a lower handguard). Moreover, the locking plate system 300 may allow a standard AR barrel with barrel extension assembly to be used on this platform. Furthermore, the built-in detent of the locking plate system 300 may prevent the locking plate system 300 (e.g., the barrel locking screws) from becoming loose. Additionally, the travel-limit screw may prevent parts of the locking plate system 300 from becoming loose during mounting and removal.

It is noteworthy that the dimensions of various components of the proposed design may be adjusted to suit actual implementations. For instance, the overall size may be enlarged for implementation on a firearm of the AR10 platform (e.g., one chambered in 308 Winchester or 7.62×51 mm NATO). Similarly, the overall style may be changed. Likewise, the overall size may be reduced for implementation on a firearm of the AR15 platform (e.g., one chambered in 0.223 Remington or 5.56×54 mm NATO). It is also noteworthy that each component of monolithic upper receiver 100, charging handle assembly 200 and barrel locking system 300 may be made of a suitable material (e.g., a suitable metal such as steel, aluminum or alloy) with appropriate mechanical properties such as sufficient strengths and/or hardness to withstand vibrations caused by firing of ammunition cartridges.

It is further noteworthy that term "AR platform" herein refers to firearms based on the AR15 platform and the AR10 platform, as well as any variation and derivative thereof, and include AR15-styled and AR10-styled firearms, including rifles, carbines, pistols and shotguns. A firearm based on an AR platform may be chambered in one of a plethora of calibers. Some of the more popular calibers include such as, for example and without limitation, 0.223 Remington, 5.56×54 mm NATO, 0.224 Valkyrie, 300 AAC Blackout, 7.62×39 mm, 458 SOCOM, 6.5 mm Grendel, 6.8 mm Remington SPC, 308 Winchester and 7.62×51 mm NATO, just to name a few. Accordingly, the proposed design in accordance with the present disclosure may be implemented in any firearm based on the AR platform (whether the AR15 platform or the AR10 platform), as well as any variation and derivative thereof, in any suitable caliber.

EXAMPLE IMPLEMENTATIONS

In view of the above, the proposed designs of a monolithic upper receiver for firearms with an ambidextrous forward assist and an improved barrel locking system may be implemented in many ways. For illustrative purposes and without limiting the scope of the present disclosure, a few example implementations of the proposed design are described below.

In one aspect, a device implementable on a firearm (e.g., a firearm based on an AR platform such as an AR15-styled or AR10-styled rifle, carbine, pistol or shotgun) may include a charging handle assembly configured to be coupled to an operating rod of a gas system of the firearm and forward of a BCG of the firearm. Accordingly, in operation: (a) the charging handle assembly may be configured to be pulled rearward with respect to the firearm to engage with a front end of the operating rod, and (b) when in a forward assist mode, the charging handle assembly may be configured to be pulled forward with respect to the firearm to pull the operating rod and the BCG forward.

In some implementations, the charging handle assembly may include a foldable charging handle including a foldable arm and a foldable charging handle base. Accordingly, the foldable arm may be pivotably coupled to the foldable charging handle base such that foldable arm is pivotable between a folded position and an extended position.

In some implementations, the charging handle assembly may also include an assembly base with a through hole horizontally traversing through the assembly base between a left side thereof and a right side thereof with respect to the firearm. Accordingly, the foldable charging handle base may be slidingly receivable in the through hole such that the foldable charging handle base is slidable between a first position, corresponding to a normal mode of the charging handle assembly, and a second position, corresponding to the forward assist mode of the charging handle assembly.

In some implementations, the foldable arm may be on either a left side of the firearm or a right side of the firearm when the foldable charging handle base is received in the through hole of the assembly base. Accordingly, when the foldable charging handle base is at the first position, the foldable arm may be closer to the assembly base when the charging handle assembly is in the normal mode. Moreover, when the foldable charging handle base is at the second position, the foldable arm may be farther from the assembly base when the charging handle assembly is in the forward assist mode.

In some implementations, the charging handle assembly may further include a first detent and a second detent. Accordingly, the assembly base may be configured with holes in which the first and second detents are received. Additionally, a side of the foldable charging handle base facing the first and second detents when the foldable charging handle base may be slidingly received in the through hole of the assembly base is configured with a plurality of indents. Moreover, when the foldable charging handle base is at the first position with the charging handle assembly in the normal mode, both of the first and second detents may be engaged with two of the plurality of indents. Furthermore, when the foldable charging handle base is at the second position with the charging handle assembly in the forward assist mode, either of the first and second detents may be engaged with one of the plurality of indents.

In some implementations, the device may further include a monolithic upper receiver comprising an upper receiver portion and a handguard portion that are integra parts of the monolithic upper receiver which is a one-piece component of the firearm. Accordingly, the upper receiver portion may be configured to receive the BCG therein and is configured to mate with a lower receiver of the firearm. Additionally, the handguard portion may be configured to surround a barrel assembly of the firearm when the barrel assembly is coupled to the upper receiver portion. Moreover, when the charging handle assembly is installed in the handguard portion, a foldable charging handle of the charging handle assembly may protrude out of a left slot on a left side of the handguard portion or a right slot on a right side of the handguard portion.

In some implementations, the monolithic upper receiver may be configured to accommodate non-proprietary barrel assemblies dimensioned according to United States military standard (mil-spec) barrel assembly dimensions and non-proprietary BCGs dimensioned according to mil-spec BCG dimensions.

In one aspect, a device implementable on a firearm (e.g., a firearm based on an AR platform such as an AR15-styled or AR10-styled rifle, carbine, pistol or shotgun) may include a barrel locking system including, for each of two opposite sides of a barrel assembly of the firearm, a locking plate and a locking screw. In some implementations, the locking plate may be configured with a threaded hole to accommodate the locking screw. Accordingly, when the locking screw is screwed into the threaded hole, the locking plate may be configured to engage with a side of a barrel extension of the barrel assembly in a radial directions perpendicular to a longitudinal axis of the barrel assembly.

In some implementations, a contacting surface of the locking plate that contacts a rim of the barrel extension is configured may be sloped to allow the locking plate to adapt to different diameter and thickness tolerances of the barrel extension.

In some implementations, when the barrel assembly is secured to the upper receiver of the firearm by the barrel locking system, an angle between the contacting surface and the longitudinal axis of the barrel assembly may be less than 90°.

In some implementations, as the locking screw is screwed into the threaded hole, the contacting surface may exert a force on the rim of the barrel extension in at least a direction that secures the barrel extension on a mounting surface on an upper receiver of the firearm.

In some implementations, for each of the two opposite sides of the barrel assembly of the firearm, the barrel locking system may also include a detent ball and a detent spring. Accordingly, for each of the two opposite sides of the barrel assembly of the firearm, the locking plate may be configured with a hole in which the detent spring and the detent ball are received with the detent ball disposed between the detent spring and the locking screw when the locking screw is received in the threaded hole of the locking plate. Moreover, for each of the two opposite sides of the barrel assembly of the firearm, a surface of the locking screw that faces the locking plate when the locking screw is received in the threaded hole of the locking plate may be configured with a plurality of indents such that the detent ball is received in one of the plurality of indents in a round-robin fashion as the locking screw is screwed into the threaded hole and as the locking screw is screwed out of the threaded hole.

In some implementations, for each of the two opposite sides of the barrel assembly of the firearm, the barrel locking system may further include a travel-limit screw. Accordingly, for each of the two opposite sides of the barrel assembly of the firearm, the locking plate may be configured with a groove on an exterior surface thereof. Additionally, for each of the two opposite sides of the barrel assembly of the firearm, the travel-limit screw may be at least partially received in the groove through a through hole on the firearm to limit a movement of the locking plate to prevent the locking plate from falling off from the firearm.

In some implementations, the device may further include a monolithic upper receiver including an upper receiver portion and a handguard portion that are integra parts of the monolithic upper receiver which is a one-piece component of the firearm. In some implementations, the upper receiver portion may be configured to receive a BCG of the firearm therein and is configured to mate with a lower receiver of the firearm. Accordingly, the handguard portion may be configured to surround the barrel assembly when the barrel assembly is coupled to the upper receiver portion. Moreover, the barrel locking system may be installed at an interface of the handguard portion and the upper receiver portion of the monolithic upper receiver.

In some implementations, the monolithic upper receiver may be configured to accommodate non-proprietary barrel assemblies dimensioned according to mil-spec barrel assembly dimensions and non-proprietary BCGs dimensioned according to mil-spec BCG dimensions.

In one aspect, a device implementable on a firearm (e.g., a firearm based on an AR platform such as an AR15-styled or AR10-styled rifle, carbine, pistol or shotgun) may include a monolithic upper receiver including an upper receiver portion and a handguard portion that are integra parts of the monolithic upper receiver which is a one-piece component of the firearm. In some implementations, the monolithic upper receiver may be configured to accommodate non-proprietary barrel assemblies dimensioned according to mil-spec barrel assembly dimensions and non-proprietary BCGs dimensioned according to mil-spec BCG dimensions.

In some implementations, the device may also include a charging handle assembly configured to be coupled to an operating rod of a gas system of the firearm and forward of a BCG of the firearm. Accordingly, in operation: (a) the charging handle assembly may be configured to be pulled rearward with respect to the firearm to engage with a front end of the operating rod, and (b) when in a forward assist mode, the charging handle assembly may be configured to be pulled forward with respect to the firearm to pull the operating rod and the BCG forward.

In some implementations, the charging handle assembly may include a foldable charging handle including a foldable arm and a foldable charging handle base. Accordingly, the foldable arm may be pivotably coupled to the foldable charging handle base such that foldable arm is pivotable between a folded position and an extended position.

In some implementations, the charging handle assembly may also include an assembly base with a through hole horizontally traversing through the assembly base between a left side thereof and a right side thereof with respect to the firearm. Accordingly, the foldable charging handle base may be slidingly receivable in the through hole such that the foldable charging handle base is slidable between a first position, corresponding to a normal mode of the charging handle assembly, and a second position, corresponding to the forward assist mode of the charging handle assembly.

In some implementations, the foldable arm may be on either a left side of the firearm or a right side of the firearm when the foldable charging handle base is received in the through hole of the assembly base. Accordingly, when the foldable charging handle base is at the first position, the foldable arm may be closer to the assembly base when the charging handle assembly is in the normal mode. Moreover, when the foldable charging handle base is at the second position, the foldable arm may be farther from the assembly base when the charging handle assembly is in the forward assist mode.

In some implementations, the charging handle assembly may further include a first detent and a second detent. Accordingly, the assembly base may be configured with holes in which the first and second detents are received. Additionally, a side of the foldable charging handle base facing the first and second detents when the foldable charging handle base may be slidingly received in the through hole of the assembly base is configured with a plurality of indents. Moreover, when the foldable charging handle base is at the first position with the charging handle assembly in the normal mode, both of the first and second detents may be engaged with two of the plurality of indents. Furthermore, when the foldable charging handle base is at the second position with the charging handle assembly in the forward assist mode, either of the first and second detents may be engaged with one of the plurality of indents.

In some implementations, the device may include a barrel locking system including, for each of two opposite sides of a barrel assembly of the firearm, a locking plate and a locking screw. In some implementations, the locking plate may be configured with a threaded hole to accommodate the locking screw. Accordingly, when the locking screw is screwed into the threaded hole, the locking plate may be configured to engage with a side of a barrel extension of the barrel assembly in a radial directions perpendicular to a longitudinal axis of the barrel assembly.

In some implementations, a contacting surface of the locking plate that contacts a rim of the barrel extension is configured may be sloped to allow the locking plate to adapt to different diameter and thickness tolerances of the barrel extension.

In some implementations, when the barrel assembly is secured to the upper receiver of the firearm by the barrel locking system, an angle between the contacting surface and the longitudinal axis of the barrel assembly may be less than 90°.

In some implementations, as the locking screw is screwed into the threaded hole, the contacting surface may exert a force on the rim of the barrel extension in at least a direction that secures the barrel extension on a mounting surface on an upper receiver of the firearm.

In some implementations, for each of the two opposite sides of the barrel assembly of the firearm, the barrel locking system may also include a detent ball and a detent spring. Accordingly, for each of the two opposite sides of the barrel assembly of the firearm, the locking plate may be configured with a hole in which the detent spring and the detent ball are received with the detent ball disposed between the detent spring and the locking screw when the locking screw is received in the threaded hole of the locking plate. Moreover, for each of the two opposite sides of the barrel assembly of the firearm, a surface of the locking screw that faces the locking plate when the locking screw is received in the threaded hole of the locking plate may be configured with a plurality of indents such that the detent ball is received in one of the plurality of indents in a round-robin fashion as the locking screw is screwed into the threaded hole and as the locking screw is screwed out of the threaded hole.

In some implementations, for each of the two opposite sides of the barrel assembly of the firearm, the barrel locking system may further include a travel-limit screw. Accordingly, for each of the two opposite sides of the barrel assembly of the firearm, the locking plate may be configured with a groove on an exterior surface thereof. Additionally, for each of the two opposite sides of the barrel assembly of the firearm, the travel-limit screw may be at least partially received in the groove through a through hole on the firearm to limit a movement of the locking plate to prevent the locking plate from falling off from the firearm.

ADDITIONAL NOTES

The herein-described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

Further, with respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Moreover, it will be understood by those skilled in the art that, in general, terms used herein, and especially in the appended claims, e.g., bodies of the appended claims, are generally intended as "open" terms, e.g., the term "including" should be interpreted as "including but not limited to," the term "having" should be interpreted as "having at least," the term "includes" should be interpreted as "includes but is not limited to," etc. It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to implementations containing only one such recitation, even when the same claim includes the introductory phrases "one or more" or "at least one" and indefinite articles such as "a" or "an," e.g., "a" and/or "an" should be interpreted to mean "at least one" or "one or more;" the same holds true for the use of definite articles used to introduce claim recitations. In addition, even if a specific number of an introduced claim recitation is explicitly recited, those skilled in the art will recognize that such recitation should be interpreted to mean at least the recited number, e.g., the bare recitation of "two recitations," without other modifiers, means at least two recitations, or two or more recitations. Furthermore, in those instances where a convention analogous to "at least one of A, B, and C, etc." is used, in general such a construction is intended in the sense one having skill in the art would understand the convention, e.g., "a system having at least one of A, B, and C" would include but not be limited to systems that have A alone, B alone, C alone, A and B together, A and C together, B and C together, and/or A, B, and C together, etc. In those instances where a convention analogous to "at least one of A, B, or C, etc." is used, in general such a construction is intended in the sense one having skill in the art would understand the convention, e.g., "a system having at least one of A, B, or C" would include but not be limited to systems that have A alone, B alone, C alone, A and B together, A and C together, B and C together, and/or A, B, and C together, etc. It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

From the foregoing, it will be appreciated that various implementations of the present disclosure have been described herein for purposes of illustration, and that various modifications may be made without departing from the scope and spirit of the present disclosure. Accordingly, the various implementations disclosed herein are not intended to be limiting, with the true scope and spirit being indicated by the following claims.

What is claimed is:

1. A device implementable on a firearm, comprising:
- a barrel locking system comprising, for each of two opposite sides of a barrel assembly of the firearm:
  - a locking plate; and
  - a locking screw,
- wherein:
  - the locking plate is configured with a threaded hole to accommodate the locking screw, and
  - when the locking screw is screwed into the threaded hole, the locking plate is configured to engage with a side of a barrel extension of the barrel assembly in a radial directions perpendicular to a longitudinal axis of the barrel assembly.

2. The device of claim 1, wherein a contacting surface of the locking plate that contacts a rim of the barrel extension is configured is sloped to allow the locking plate to adapt to different diameter and thickness tolerances of the barrel extension.

3. The device of claim 2, wherein, when the barrel assembly is secured to the upper receiver of the firearm by the barrel locking system, an angle between the contacting surface and the longitudinal axis of the barrel assembly is less than 90°.

4. The device of claim 2, wherein, as the locking screw is screwed into the threaded hole, the contacting surface exerts a force on the rim of the barrel extension in at least a direction that secures the barrel extension on a mounting surface on an upper receiver of the firearm.

5. The device of claim 1, wherein, for each of the two opposite sides of the barrel assembly of the firearm, the barrel locking system further comprises:
- a detent ball; and
- a detent spring,
- wherein, for each of the two opposite sides of the barrel assembly of the firearm:
  - the locking plate is configured with a hole in which the detent spring and the detent ball are received with the detent ball disposed between the detent spring and the locking screw when the locking screw is received in the threaded hole of the locking plate, and
  - a surface of the locking screw that faces the locking plate when the locking screw is received in the threaded hole of the locking plate is configured with a plurality of indents such that the detent ball is received in one of the plurality of indents in a round-robin fashion as the locking screw is screwed into the threaded hole and as the locking screw is screwed out of the threaded hole.

6. The device of claim 1, wherein, for each of the two opposite sides of the barrel assembly of the firearm, the barrel locking system further comprises:
- a travel-limit screw,
- wherein, for each of the two opposite sides of the barrel assembly of the firearm:
  - the locking plate is configured with a groove on an exterior surface thereof, and
  - the travel-limit screw is at least partially received in the groove through a through hole on the firearm to limit a movement of the locking plate to prevent the locking plate from falling off from the firearm.

7. The device of claim 1, further comprising:

a monolithic upper receiver comprising an upper receiver portion and a handguard portion that are integra parts of the monolithic upper receiver which is a one-piece component of the firearm, wherein:

the upper receiver portion is configured to receive a bolt carrier group (BCG) of the firearm therein and is configured to mate with a lower receiver of the firearm, the handguard portion is configured to surround the barrel assembly when the barrel assembly is coupled to the upper receiver portion, and the barrel locking system is installed at an interface of the handguard portion and the upper receiver portion of the monolithic upper receiver.

8. The device of claim 7, wherein the monolithic upper receiver is configured to accommodate non-proprietary barrel assemblies dimensioned according to United States military standard (mil-spec) barrel assembly dimensions and non-proprietary BCGs dimensioned according to mil-spec BCG dimensions.

9. A device implementable on a firearm, comprising:

a monolithic upper receiver comprising an upper receiver portion and a handguard portion that are integra parts of the monolithic upper receiver which is a one-piece component of the firearm; and a barrel locking system comprising, for each of two opposite sides of a barrel assembly of the firearm:

a locking plate; and a locking screw, wherein:

the locking plate is configured with a threaded hole to accommodate the locking screw, and when the locking screw is screwed into the threaded hole, the locking plate is configured to engage with a side of a barrel extension of the barrel assembly in a radial directions perpendicular to a longitudinal axis of the barrel assembly.

10. The device of claim 9, wherein a contacting surface of the locking plate that contacts a rim of the barrel extension is configured is sloped to allow the locking plate to adapt to different diameter and thickness tolerances of the barrel extension.

11. The device of claim 10, wherein, when the barrel assembly is secured to the upper receiver of the firearm by the barrel locking system, an angle between the contacting surface and the longitudinal axis of the barrel assembly is less than 90°.

12. The device of claim 10, wherein, as the locking screw is screwed into the threaded hole, the contacting surface exerts a force on the rim of the barrel extension in at least a direction that secures the barrel extension on a mounting surface on an upper receiver of the firearm.

13. The device of claim 9, wherein, for each of the two opposite sides of the barrel assembly of the firearm, the barrel locking system further comprises:

a detent ball; and a detent spring, wherein, for each of the two opposite sides of the barrel assembly of the firearm:

the locking plate is configured with a hole in which the detent spring and the detent ball are received with the detent ball disposed between the detent spring and the locking screw when the locking screw is received in the threaded hole of the locking plate, and a surface of the locking screw that faces the locking plate when the locking screw is received in the threaded hole of the locking plate is configured with a plurality of indents such that the detent ball is received in one of the plurality of indents in a round-robin fashion as the locking screw is screwed into the threaded hole and as the locking screw is screwed out of the threaded hole.

14. The device of claim 9, wherein, for each of the two opposite sides of the barrel assembly of the firearm, the barrel locking system further comprises:

a travel-limit screw, wherein, for each of the two opposite sides of the barrel assembly of the firearm:

the locking plate is configured with a groove on an exterior surface thereof, and the travel-limit screw is at least partially received in the groove through a through hole on the firearm to limit a movement of the locking plate to prevent the locking plate from falling off from the firearm.

* * * * *